US006564526B2

(12) United States Patent
Chambers

(10) Patent No.: US 6,564,526 B2
(45) **Date of Patent: *May 20, 2003**

(54) ACCELERATED LOG BUILDING METHOD

(75) Inventor: Robert W. Chambers, River Falls, WI (US)

(73) Assignee: Accelerated Log Building, Inc., River Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/099,601

(22) Filed: Mar. 14, 2002

(65) Prior Publication Data

US 2002/0088200 A1 Jul. 11, 2002

Related U.S. Application Data

(63) Continuation of application No. 09/517,368, filed on Mar. 2, 2000.

(51) Int. Cl.[7] ..... E04B 1/10

(52) U.S. Cl. ..... 52/747.1; 52/233; 52/592.5; 52/745.01; 52/745.05

(58) Field of Search ..... 52/745.01, 745.05, 52/745.09, 233, 592.5

(56) References Cited

U.S. PATENT DOCUMENTS

| | | | | | |
|---|---|---|---|---|---|
| 2,525,659 | A | * | 10/1950 | Edson et al. | 20/4 |
| 3,381,428 | A | * | 5/1968 | Sillman | 52/233 |
| 3,863,409 | A | * | 2/1975 | Fell | 446/106 |
| 4,510,724 | A | | 4/1985 | Magnuson | 52/233 |
| 4,951,435 | A | | 8/1990 | Beckedorf | 52/233 |
| 5,103,610 | A | * | 4/1992 | Walters | 52/233 |
| 5,718,091 | A | * | 2/1998 | Sellers et al. | 144/347 |
| 6,023,895 | A | * | 2/2000 | Anderson | 52/233 |
| 6,412,241 | B1 | * | 7/2002 | Chambers | 52/233 |

OTHER PUBLICATIONS

Robert W. Chambers, "Log Building Construction Manual", 1998.

"Log Cabins", American Builder, Feb. 1933, p. 33 and 58.

* cited by examiner

*Primary Examiner*—Carl D. Friedman
*Assistant Examiner*—Basil Katcheves
(74) *Attorney, Agent, or Firm*—Fredrikson & Byron, P.A.

(57) ABSTRACT

A method of building a log structure using naturally-shaped logs is provided. The method involves stacking layers of the log structure upon one another in a rough approximation of the final desired positioning, determining the distance of the greatest gap existing between the pairs of logs at each layer, determining groove cuts to be made for every log in the same layer using the same vertical groove dimension, determining a dimension of a final notch cut to be made in the logs of the lowest layer stacked according to this invention, and determining the final notch cuts to be made at layers above according to a relationship among the vertical groove dimensions that were marked for each of the grooves in a single layer and the dimension of the final notch cut determined for the lowest layer of logs stacked according to the present invention.

13 Claims, 10 Drawing Sheets

ACCELERATED LOG BUILDING METHOD

CROSS REFERENCE TO RELATED APPLICATIONS

The present application is a continuation of U.S. patent application filed Mar. 2, 2000 and assigned Ser. No. 09/517,368, the entire disclosure of which is incorporated herein by reference.

FIELD OF THE INVENTION

The present invention relates to the construction of a log wall or structure. More particularly, this invention relates to a method for constructing a log wall or structure using naturally-shaped logs.

BACKGROUND OF THE INVENTION

Log structures have been built for centuries. Historically, log structures were handcrafted using logs in their natural shape. That is, using logs that retain the unique, natural shapes of the trees from which they came. More recently, log buildings have been constructed using prefabricated logs. For example, such logs are commonly manufactured to have a common shape, whereby they can be used interchangeably. While prefabricated log structures can be built more quickly and affordably than those built by hand, many people prefer the aesthetics of a handcrafted log home. Accordingly, handcrafted homes remain popular even though their construction commonly involves significant time and expense.

The general procedure used in log construction developed long before the advent of cranes and other mechanized lifting equipment. Because logs are heavy, awkward, and dangerous to lift, early log builders did not want to lift logs onto a wall more than once. Thus, once each log was positioned upon a wall, it was processed completely until it fit in its permanent position on the wall. Only then would the next log be processed. Thus, at any given time, only the logs that were on the exposed top layer would be processed. Even though this general procedure was invented for log construction without modern lifting equipment, this procedure is used even today by those who build handcrafted log homes. This traditional procedure will now be described as it would typically be applied in building a simple four-walled structure.

Each log is processed one-at-a-time through a series of steps to produce a handcrafted log structure. First, a set of logs are selected and the bark is removed from each log. The first-layer logs are then selected and positioned. Traditionally, each of the first-layer and second-layer logs (or "sill logs") is cut to have a planar bottom surface that will rest on the floor deck to provide the structure with a solid foundation. Two first-layer logs are positioned in a parallel, spaced-apart configuration. Each additional layer comprises two logs that are stacked crosswise over the logs of the layer below. For example, the second-layer in such a structure comprises two logs positioned in a crosswise stack on top of the first-layer logs. A notch is marked near both ends of each second-layer log, then the notches are cut, whereafter the second-layer logs are restacked over the first-layer logs with each notch fitted over the end of a first-layer log. The notches in the second-layer logs are commonly dimensioned such that the planar bottom surfaces of the second-layer logs will be flush with the planar bottom surfaces of the first-layer logs when these notches are fitted over the first-layer logs.

Once the first-layer and second-layer logs are in place and fitted, the third-layer logs are selected and lifted into place.

Each third-layer log is positioned in a crosswise stack atop the second-layer of logs such that each third-layer log lies directly above a first-layer log. At this stage, there is a gap between each pair of adjacent first-layer and third-layer logs. This gap will often be wider at one end than at the other. Both ends of this gap are measured to determine how the adjacent third-layer log can be lowered to make the gaps more uniform from end to end. A rough notch is then cut into the end of the third-layer log that is adjacent the wide end of the gap. The depth of this rough notch is such that when it is fitted over the second-layer log below, the third-layer log is lowered to a position where the vertical height of the gap is about the same at both ends. Commonly, a rough notch is cut into both ends of each third-layer log so each gap is made to be both less tall and more uniform.

Even after rough notching, there will be one point where the gap between each pair of adjacent first-layer and third-layer logs is greatest. This is because each log has a unique and irregular shape that corresponds to the natural shape of the tree from which it came. The maximum height of this gap is measured for each pair of adjacent first-layer and third-layer layer logs.

A marking instrument similar to an inside caliper is then used to mark (or "scribe") a long groove that will be cut in the bottom surface of each third-layer log. The marking points of the caliper (or "scriber") are set to a distance (the "scribe setting") that is slightly greater than the maximum gap height that was found for that particular pair of adjacent first-layer and third-layer logs. Because the maximum gap between each pair of adjacent first-layer and third-layer logs will be different, the scribe setting for each such pair will likewise be different.

The scriber is used to mark a final notch cut on both ends of each third-layer log. The scriber is used to mark a final notch cut that will lower each end of each third-layer log by the same distance that was used to mark the long groove cut for that pair of logs.

The long groove and the final notches are then cut for each third-layer log. This is commonly done by rolling each third-layer log upside down and cutting the long groove and the final notches that have been scribed. Alternatively, each third-layer log may be removed from the wall and placed near the ground for cutting. Each third-layer log is then put in its finally fitted position. Only after the third-layer logs have been completely processed and fitted into their final position, does the builder begin working on the fourth-layer logs. The same steps are performed for each fourth-layer log until each log in the fourth-layer is fitted into its final position. This process is repeated for each of the remaining logs in the walls of the structure. Thus, each log on the exposed upper layer is fully processed and placed into its final, permanent position before any work is done on logs of higher layers.

As can be seen, the traditional method of fully processing each log one log at a time is inefficient and slow. For example, a four-walled building with nine logs in each wall will comprise 36 logs. However, using the traditional method, only two out of 36 logs are processed at one time. Thus, even a small, simple log structure takes a long time to build with the traditional method. Clients can be frustrated by the slow pace at which handcrafted structures are built. Accordingly, the development of the log building industry has been affected by the high costs and lengthy wait-times that are characteristic of the traditional log-by-log building method.

In short, traditional methods are adequately suited to building on the final foundation and without a crane.

However, they are poorly suited to building off-site and with a crane. Traditional methods were great in the year 1620, but they are just poor business choices for the year 2001.

Modern mass-production methods typically benefit from using work forces comprised of specialized laborers rather than small work crews of highly-skilled craftsmen. It is difficult to use a large number of workers in traditional log building methodology. Since only a few logs are processed at one time, there is only enough work for a few workers to do. Thus, log building companies typically keep each work crew small. Furthermore, when crews are small, it is useful if each worker is skilled at performing many log construction tasks. This makes specialization of labor difficult. It is also time-consuming and costly to hire and keep workers who are proficient at the full spectrum of tasks. Likewise, it is expensive to adequately train workers in all of the numerous skills required in log building. Furthermore, those workers who become skilled at all aspects of log construction are sometimes tempted to leave employment to start their own log construction business. In summary, log building companies can find employment, training, and maintenance of skilled workers and crews to be a continuing expense.

The traditional method of log building can also be unsafe. It can be difficult and expensive to erect scaffolding around a log structure during construction. Thus, where long grooves are cut into logs that are resting atop walls, workers may be required to walk backwards on top of the log walls while operating a chainsaw. This can obviously be unsafe. For example, this may be the case where double-cut long grooves are used. This type of groove is disclosed in U.S. Pat. No. 4,951,435, which is issued to Beckedorf (the incorporations of which are herein incorporated by reference).

It is common to assemble each log shell twice using traditional log building methods. Commonly, the shell is built once at the construction yard and again at its final location. Since each log is fully processed one at a time with the traditional method, this adds significantly to the construction time. This also means that each log is handled many times. Inevitably, there are costs and risks each time that heavy, awkward logs are handled at a construction site. There is a risk of accident each time a log is moved or lifted. Furthermore, the peeled, natural surface of each log can be scratched and dented by lifting tongs. Such damage is undesirable since the peeled surface of the log commonly serves as the finished surface of the walls.

Surprisingly, log home builders today use the same basic procedures that builders were using hundreds of years ago. Processing one log at a time is time-consuming and costly. It would be desirable to provide a method of building handcrafted structures with naturally-shaped logs that would allow builders to process more than one log at one time. It would be particularly desirable to provide a method that would allow builders to process all of the logs in the walls of a log structure at the same time.

SUMMARY OF THE INVENTION

One embodiment of the invention provides a method of building a structure having a plurality of log walls. The method comprises providing a plurality of logs wherein each log has a first end region and a second end region. A first layer of logs is positioned in a spaced-apart configuration. A second layer of logs is positioned above the first layer of logs in a crosswise stack wherein each end region of each second-layer log rests above a first-layer log. A third layer of logs is positioned above the second layer of logs in a crosswise stack wherein each end region of each third-layer log rests above a second-layer log, and wherein each third-layer log lies above and extends alongside an adjacent first-layer log to define a pair of adjacent first-layer and third-layer logs, whereby a first gap is formed between each such pair of adjacent first-layer and third-layer logs. A fourth layer of logs is positioned above the third layer of logs in a crosswise stack wherein each end region of each fourth-layer log rests above a third-layer log, and wherein each fourth-layer log lies above and extends alongside an adjacent second-layer log to define a pair of adjacent second-layer and fourth-layer logs, whereby a second gap is formed between each such pair of adjacent second-layer and fourth-layer logs. A maximum height of the first gaps in the structure is determined. Long groove lines representing long groove cuts are scribed on all of the third-layer logs using a single long groove scribe setting. The single long groove scribe setting that is used for all of the third-layer logs is a first vertical distance that is at least as great as the determined maximum height of the first gaps in the structure. A maximum height of the second gaps in the structure is determined. Long groove lines representing long groove cuts are scribed on all of the fourth-layer logs using a single long groove scribe setting. The single long groove scribe setting that is used for all of the fourth-layer logs is a second vertical distance that is at least as great as the determined maximum height of the second gaps in the structure. Final notch lines are scribed on all of the second-layer logs using a single final notch scribe setting. The single final notch scribe setting that is used for all of the second-layer logs represents a final notch cut that will lower both end regions of each second-layer log by a first drop distance and into a final position when each second-layer final notch is fitted over the first-layer log on which it rests. Final notch lines are scribed on all of the third-layer logs using a single final notch scribe setting. The single final notch scribe setting that is used for all of the third-layer logs represents a final notch cut that will lower both end regions of each third-layer log by a second drop distance that is approximately equal to the first vertical distance less the first drop distance when each third-layer final notch is fitted over the second-layer log on which it rests.

In another embodiment of the invention, there is provided a method of building a structure having a plurality of log walls. The method comprises providing a plurality of logs wherein each log has a first end region and a second end region. A first layer of logs is positioned in a spaced-apart configuration. A second layer of logs is positioned above the first layer of logs in a crosswise stack wherein each end region of each second-layer log rests above a first-layer log. A third layer of logs is positioned above the second layer of logs in a crosswise stack wherein each end region of each third-layer log rests above a second-layer log, and wherein each third-layer log lies above and extends alongside an adjacent first-layer log to define a pair of adjacent first-layer and third-layer logs, whereby a first gap is formed between each such pair of adjacent first-layer and third-layer logs. A maximum height of the first gaps in the structure is determined. Long groove lines representing long groove cuts are scribed on all of the third-layer logs using a single long groove scribe setting, G1. The single long groove scribe setting, G1, that is used for all of the third-layer logs is at least as great as the determined maximum height of the first gaps in the structure. Final notch lines are scribed on all of the second-layer logs using a single final notch scribe setting, N1. The single final notch scribe setting, N1, that is used for all of the second-layer logs represents a final notch cut that will lower both end regions of each second-layer log into a final position when each second-layer final notch is fitted over the first-layer log on which it rests. Final notch lines representing final notch cuts are scribed on all of the third-layer logs using a single final notch scribe setting, N2, where N2=G−N1.

DETAILED DESCRIPTION OF PREFERRED EMBODIMENTS

Figure 1:
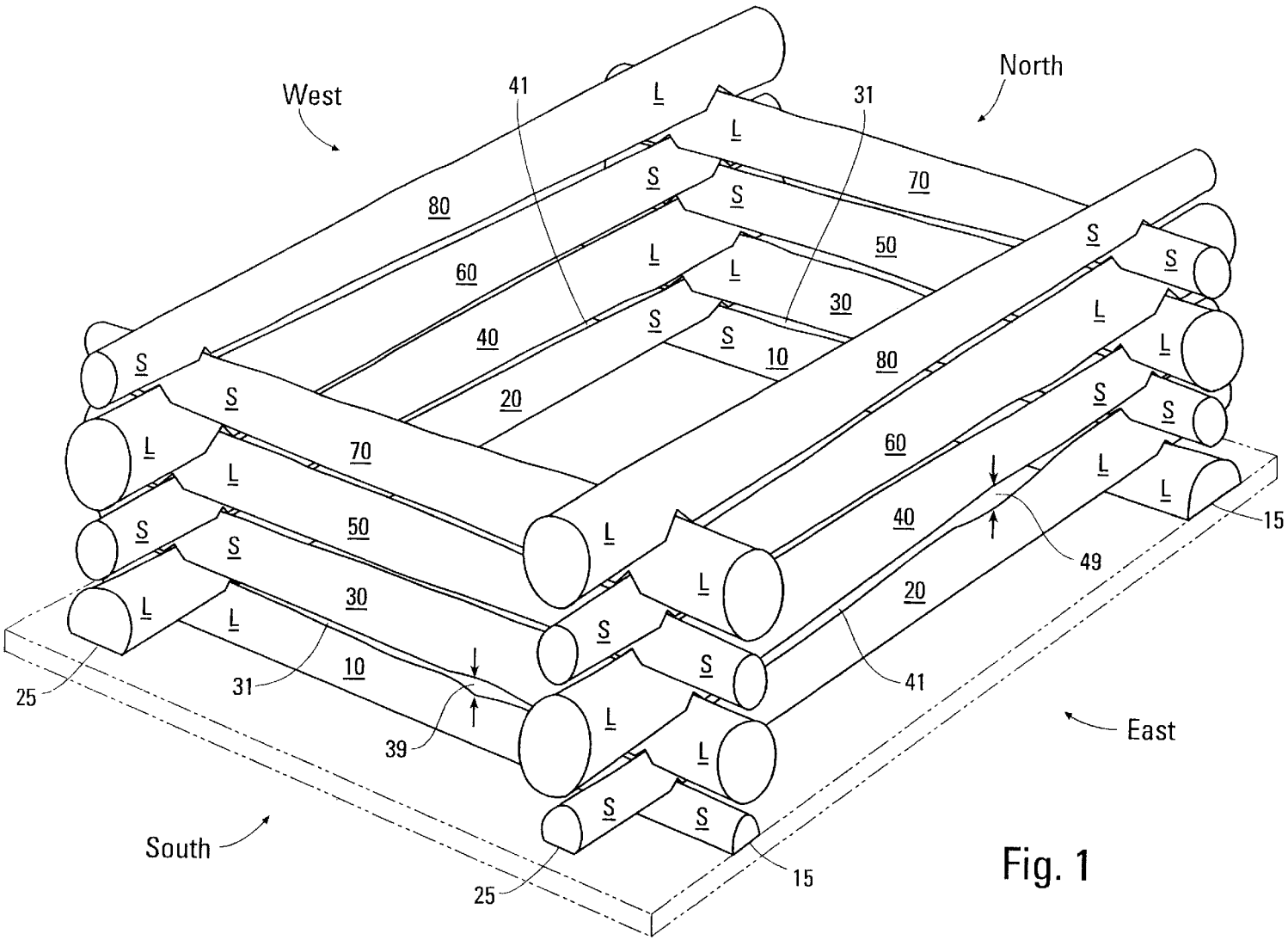
FIG. 1 is a perspective view illustrating a crosswise stack of logs formed according to one aspect of the present invention.

Log structures of the present invention are built using a plurality of logs wherein each log has a first end region and a second end region. The first and second end regions are respectively adjacent to the first and second ends of each log. A span extends longitudinally between the first and second ends of each log.

The invention can be used quite advantageously to build log structures using naturally shaped logs. It is to be understood that a log will be referred to herein as "naturally shaped" if it has substantially the same shape as the tree from which it came. Most naturally shaped logs are tapered, and have a small end (or a "tip") and a large end (or a "butt"). Accordingly, discussion herein typifies use of the present invention to build structures using logs that have a small end and a large end. However, it would be obvious to those skilled in the art of building or designing log structures that the present invention could also be used to build structures with naturally shaped logs that have little or no taper.

The bark is commonly removed from each log before construction begins. This may be accomplished by hand or by machine. If desired, the logs may also be sanded or otherwise prepared.

Structures can be built according to the present invention using logs with any diameter. Logs having a diameter of at least 10 inches at their small end give excellent results for many structures. However, smaller logs would also give acceptable results. Particularly desirably results have been achieved using logs with an average diameter of 14 inches or more. The selection of logs may also be based on the personal preference of the builder or client. For example, some people may prefer logs that have unusually small diameters, while others may prefer logs with unusually large diameters. In any event, selecting a set of logs that will be suitable for a particular structure is well within the capability of those skilled in the art of designing or building log structures.

A first layer of logs is positioned in a spaced-apart configuration. It is to be understood that the term "first layer" will be used herein to refer to the first layer of logs that is added to a structure in accordance with the present invention. As would be obvious to those skilled in the art of log building, one could begin to practice the present invention at any layer in a structure. For example, the bottommost three layers in a structure could be constructed using the traditional method of log-by-log building, whereafter additional layers could be added according to the present invention. Likewise, the bottom story of a structure could be built using traditional methods, while an upper story could be built according to the present invention. A great many variations of this nature would be obvious to those of skill in the instant art, and would fall within the scope of this invention.

In most cases, it will be optimal to build an entire structure according to the present invention. Accordingly, discussion herein will typify construction of a log structure wherein all of the layers, beginning with the bottommost layer, are added in accordance with the present invention.

Figure 4:
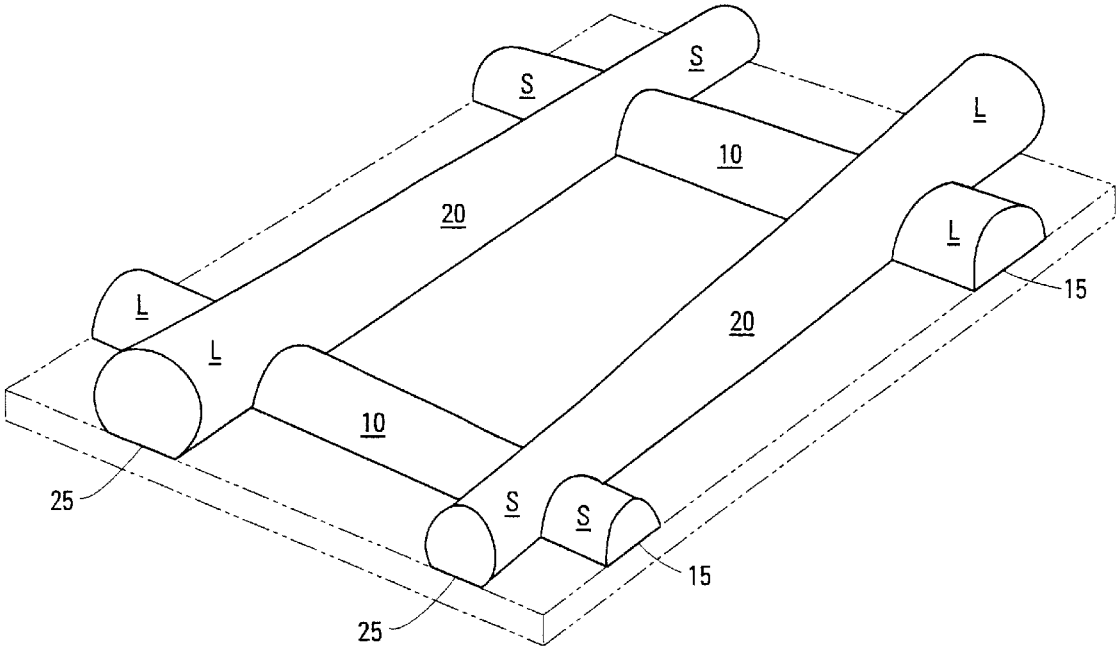
FIG. 4 is a perspective view schematically illustrating first-layer logs and second-layer logs that have been fitted in a final position according to one aspect of the present invention.

Each wall of a log structure typically has a base formed by the bottom surface of first and second-layer logs. To provide a stable base for each wall, it is common to machine first and second-layer logs such that a bottom length of each log is planar. Such logs are commonly referred to as sill logs. For example, builders commonly saw along the length of each sill log to form a flat longitudinal bottom surface. If desired, the bottom surface of each log can be further machined (such as by planing or sanding) to make it is as flat as possible. FIG. 4 shows two first-layer logs 10 that have a planar bottom surface 15 and two second-layer logs 20 that have a planar bottom surface 25. Sill logs are machined to dimensions that complement the design of each structure. Those of skill in the art would be able to process sill logs appropriately by referring to the layout of the structure being built. In most cases, it is desirable to provide each first and second-layer log with a planar bottom surface. Accordingly, discussion herein typifies use of the present invention to build a structure wherein the bottom of the first-layer and second-layer sill logs have been cut flat. However, this is certainly not a requirement in practicing the present invention.

Traditionally, the planar bottom surface of each first-layer and second-layer sill logs is cut at the beginning of the building process. That is, before any work is done on the third-layer of logs. In building structures according to the present invention, it can be advantageous to cut the planar bottoms of the sill logs later in the building process. For example, it can be advantageous to determine such cuts after the builder has determined whatever groove and final notch cuts will be made in the logs. This will be more thoroughly discussed below.

The first-layer of logs can be positioned using any suitable foundation or supports. For example, the first-layer logs may simply be placed on the ground. Alternatively, they may be placed on blocks, jacks, or other elevated surfaces that will provide stable positioning. When a log structure is initially constructed at a building yard remote from the permanent site of the structure, it is common to place the first-layer logs on temporary supports that securely hold the first-layer logs in a generally horizontal position. This may be particularly desirable where the available ground is uneven, or would not otherwise provide a suitable foundation.

In another aspect of the present invention, the first-layer logs are held in position by devices that support the ends of each first-layer log. For example, such positioning devices may comprise a short axle or a dowel pin that is bolted to each end of each log. Alternatively, these devices may include a gripping means such as one or more spikes, pins, or the like that may be pressed against or into the end surfaces of a log. For example, such spikes may be pressed into the outer ends of a log in much the same way that the pins of a corn cob holder are pressed into the outer ends of a cob of corn. The axles (or whatever gripping means are used) may be movable vertically and horizontally to allow the position of each first-layer log to be adjusted. Furthermore, such gripping means may be movable rotationally about the longitudinal axis of each log such that once a first-layer log is in a certain position, it can be rotated to orient each log according to its unique contour. For example, builders commonly orient logs that are curved or bowed (or have "sweep") in certain ways.

Figure 2B:
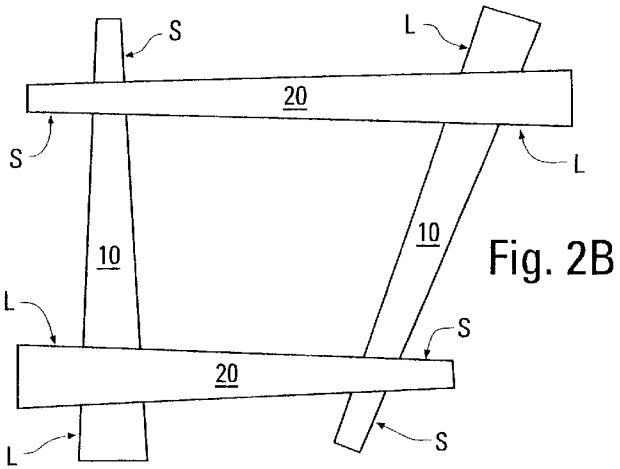
FIG. 2B is top view illustrating an alternate configuration according to which a four-walled structure could be built in accordance with the present invention.
Figure 2D:
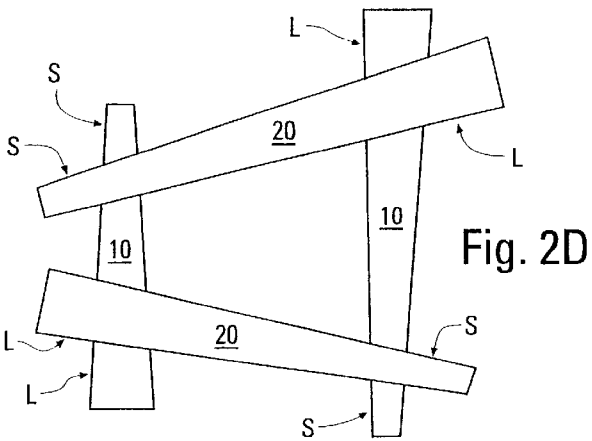
FIG. 2D is a top view illustrating an alternate configuration according to which a structure could be built in accordance with the present invention.
Figure 2A:
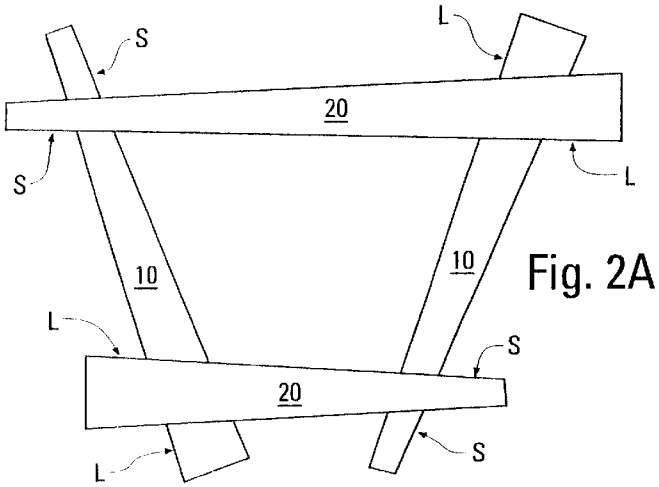
FIG. 2A is a top view illustrating a particular configuration according to which a four-walled structure could be built in accordance with the present invention.
Figure 2C:
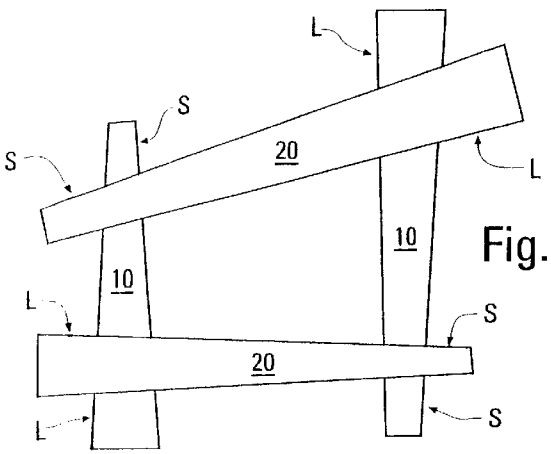
FIG. 2C is top view illustrating an alternate configuration according to which a four-walled structure could be built in accordance with the present invention.

The first-layer logs are positioned in a spaced-apart configuration that reflects the particular design of the structure being built. An infinite variety of differently laid out structures can be built according to the present invention. Consequently, the first-layer logs may be positioned in a great number of different spaced-apart configurations. In many cases, the first-layer logs will be arranged in a spaced-apart configuration wherein at least one pair of spaced-apart logs are generally parallel. For example, FIG. 1 shows a stack of logs that reflects a simple four-walled log structure. The illustrated structure comprises two generally parallel first-layer logs 10. However, a structure need not have any first-layer logs that are parallel to one another. For example, FIGS. 2A and 2B typify two particular four-walled configurations that have two first-layer logs 10 that are not parallel. Of course, depending on the layout of a particular structure, more than two first-layer logs may be provided. For example, FIG. 3 typifies a particular eight-walled configuration that has four first-layer logs 10. Those skilled in the art would be able to readily determine the positioning of each first-layer log according to the desired layout for a particular structure.

Figure 3:
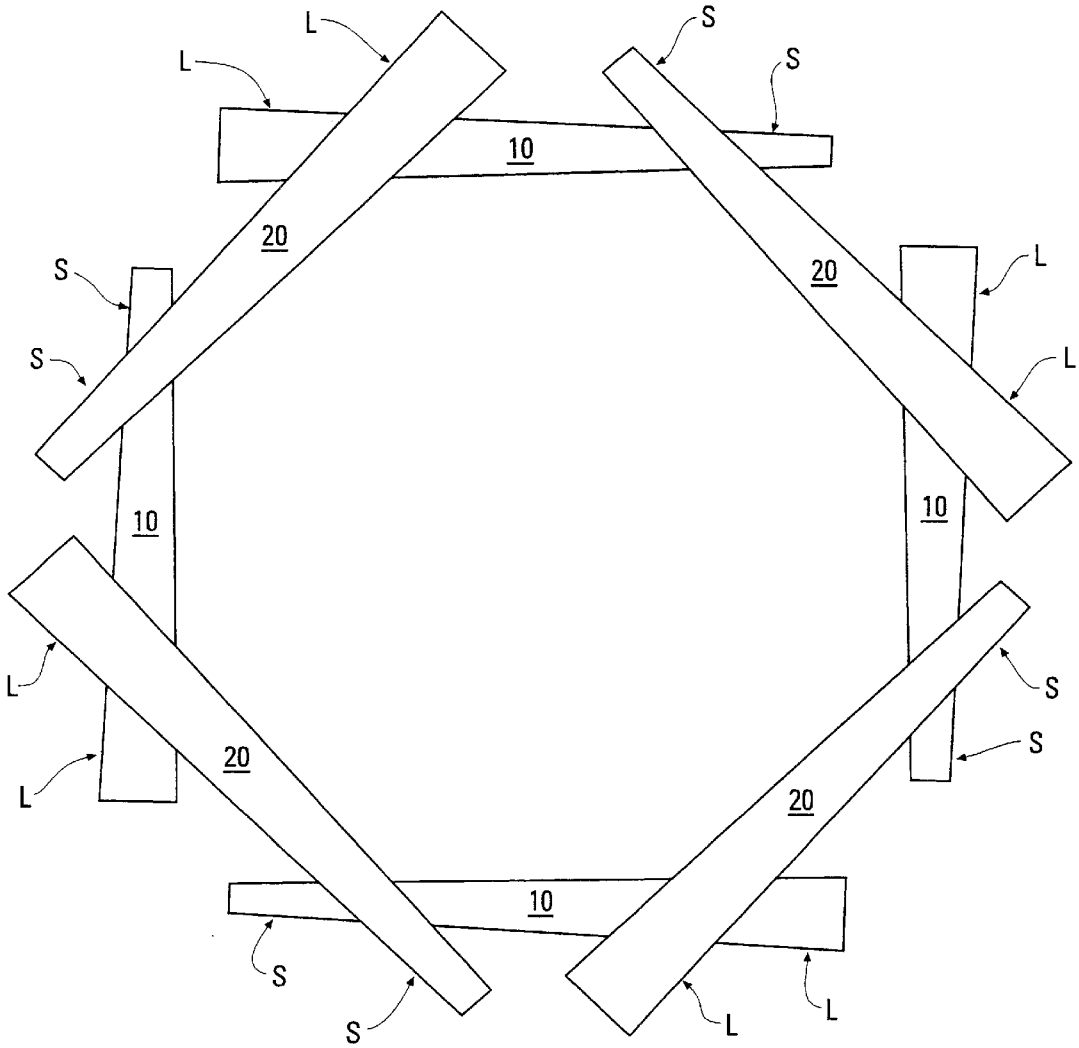
FIG. 3 is a top view illustrating a particular configuration according to which a structure could be built in accordance with the present invention.

In one aspect of the present invention, the first-layer logs are arranged in a configuration wherein at least one pair of first-layer logs are spaced apart in a generally-opposed configuration with their small and large ends inversely oriented. This would commonly be desirable where a pair of generally-opposed first-layer logs will form walls on opposite sides of a structure being built. For example, FIGS. 2A–2D illustrate configurations wherein two generally-opposed first-layer logs 10 that will form walls on opposite sides of a structure have their small S and large L ends inversely oriented. Likewise, FIG. 3 shows a configuration having four first-layer logs 10, wherein two pairs of generally-opposed first-layer logs will form walls that are on opposite sides of a structure. The logs of each generally-opposed pair have their small S and large L ends inversely oriented. This reflects a positioning pattern wherein parallel logs in the same layer have their small and large ends inversely oriented. That is, with the taper of each such log facing generally opposite directions. However, this is certainly not a requirement. For example, many builders position parallel logs in the same layer such that their small and large ends face the same direction. Variations of this nature would be obvious to those skilled in the art of designing and building log structures. Moreover, it is to be understood that the present invention can be practiced without orienting the small and large ends of the logs in any particular manner. However, as would be obvious to skilled artisans, such orientations can be used advantageously to construct walls that are approximately level.

A second layer of logs is positioned in a crosswise stack above the first layer of logs. The second layer is positioned such that each end region of each second-layer log rests above a first-layer log. Commonly, the second layer of logs is positioned such that each end region of each second-layer log actually rests on a first-layer log. For example, the four-walled structure illustrated in FIG. 1 shows two second-layer logs 20 positioned atop two first-layer logs 10 in a crosswise stack wherein each end region of each second-layer log 20 sits on one end region of a first-layer log 10. However, each end region of each second-layer log need not be contiguous with (that is, touching) the first-layer log below. For example, it may be desirable to raise one or both ends of certain second-layer logs. In this case, any suitable shim, lift, spacer, or the like may be placed between any such end region of a second-layer log and the first-layer log below. Moreover, the second-layer logs need not be directly supported by first-layer logs.

In one aspect of the present invention, one or more second-layer logs are held by positioning devices that support the ends of each log. For example, the second-layer logs may be held in position by devices (such as those discussed with reference to the first-layer logs) that are secured to both ends of each second-layer log. Logs held by such devices may be movable vertically and horizontally to allow the position of each second-layer log to be adjusted. Likewise, the logs held by such devices may be movable rotationally about the longitudinal axis of each log such that once a second-layer log is in a certain position, it can be rotated to orient each log as desired. The unique contour of naturally-shaped logs commonly makes it desirable to orient bowed logs in certain ways.

In some cases, it will be preferable if the very ends of each second-layer log are not positioned directly above a first-layer log. For example, the structure shown in FIG. 1 is stacked such that the end regions of each pair of contiguous (that is, touching) first-layer and second-layer logs overlap at a crossing point that is a certain distance from the very end of the second-layer log. In many cases, this is desirable since it will provide ample space for notches to be cut in the bottoms of each second-layer log. Furthermore, it is preferable that the end regions of the second-layer logs not be positioned above or on the very end of a first-layer log. In some cases, such positioning will not provide sufficiently stable seating for the second-layer logs. Moreover, in many cases the client or builder may desire the distinctive appearance that is achieved by structures that have such log extensions (or "flyways"). However, as would be obvious to those of skill in the art of log building, log extensions would not be required where certain types of notches are used. For example, a notch style that is commonly referred to as a "dovetail" notch has interlocking angled surfaces and can be used without log extensions.

Builders can use the present invention to construct an infinite variety of differently laid-out structures. Consequently, the second layer of logs can be arranged in a great many ways. With reference to the design of a particular structure, the general positioning of each second-layer log would be obvious to those skilled in the art of building or designing log structures.

In many cases, it will be desirable to arrange the second layer of logs such that at least one pair of second-layer logs 20 are spaced-apart in a generally parallel configuration. For example, the configuration shown in FIG. 1 comprises two spaced-apart second-layer logs that are generally parallel to one another. Similarly, the configuration typified in FIG. 3 has two pairs of spaced-apart, generally parallel second-layer logs 20. However, it is not necessary that any of the second-layer logs be parallel to one another. For example, FIGS. 2C and 2D typify two particular four-walled configurations wherein the second-layer logs 20 are not parallel to one another.

In one aspect of the present invention, the second-layer logs are arranged in a configuration wherein at least one pair of second-layer logs are spaced apart in a generally-opposed configuration with their small and large ends inversely oriented. Commonly, this would be desirable where a pair of spaced-apart second-layer logs will form walls on opposite sides of a structure. For example, FIGS. 2A–2D illustrate configurations wherein a pair of generally-opposed second-layer logs will form walls on opposite sides of a structure. Likewise, FIG. 3 shows a configuration having four second-layer logs 20, wherein two pairs of generally-opposed second-layer logs will form walls on opposite sides of a structure. The illustrated logs 20 of each generally-opposed pair have the small S and large L ends inversely oriented.

This orientation of second-layer logs reflects a common positioning pattern wherein the parallel logs in the same layer have their small and large ends facing opposite directions. As was discussed above with reference to the orientation of the first-layer logs, many builders position the parallel logs in the same layer such that their small and large ends face the same direction. Variations of this nature would be obvious to those skilled in the art of log building. Furthermore, skilled artisans in the instant field would recognize that the present invention can be practiced without orienting the small and large ends of the logs in any particular manner. However, as would be obvious to those skilled in the art of log building, such orientations can be used advantageously to construct walls that are as level as possible.

Figure 5A:
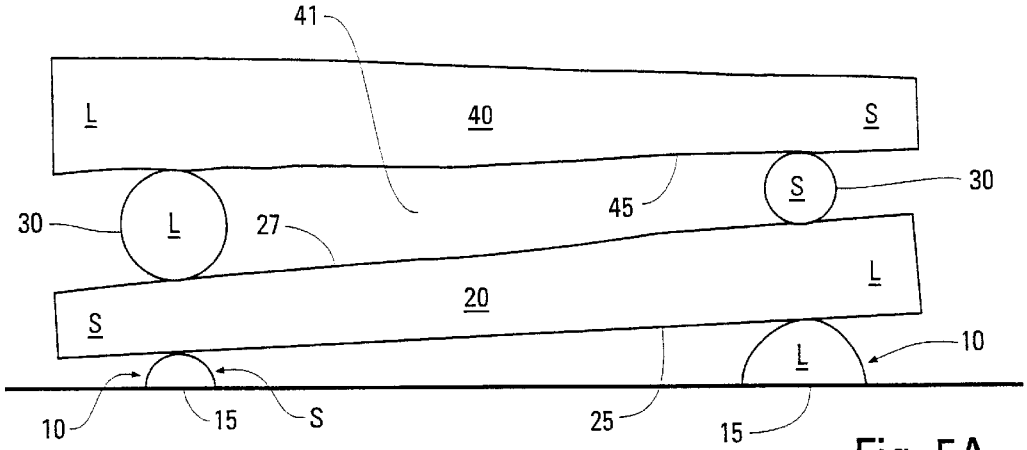
FIG. 5A is side view schematically illustrating four layers of logs that have been stacked according to one aspect of the present invention.
Figure 5B:
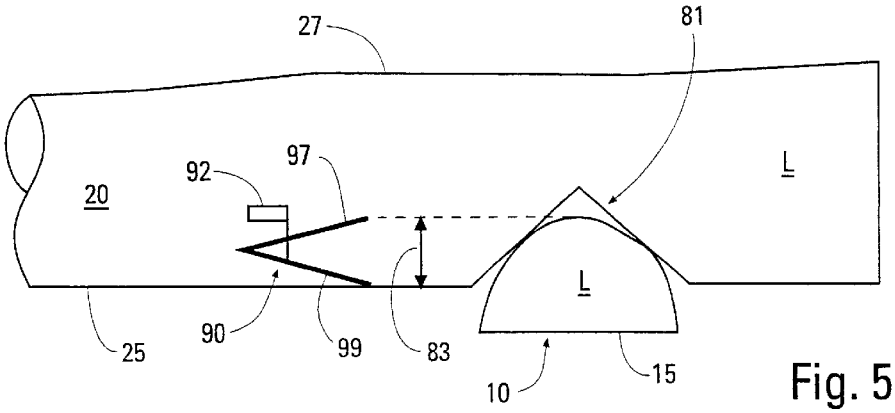
FIG. 5B is a broken away isolation view of the intersection of two logs stacked in accordance with another embodiment of the present invention.

In one aspect of the present invention, a rough notch is cut into at least one end region of each second-layer log such that the flat bottom surface of each second-layer log is generally horizontal when each second-layer rough notch is fitted over the first-layer log on which it rests. In cases where the second-layer logs have been positioned directly atop the first-layer of logs, one end region of each second-layer log will sometimes be higher than the other. For example, where one end region of a second-layer log rests on the small end region of a first-layer log while the other end region of that log rests on the large end region of a first-layer log, the former end region of the second-layer log will sometimes be higher than the latter end region. This is perhaps best seen with reference to FIG. 5A, wherein the large end region L of the illustrated second-layer log 20 rests atop the large end region L of a first-layer log 10. In this case, it would be desirable to cut a rough notch into the large end region L of the illustrated second-layer log 20 such that the flat bottom surface 25 of this log 20 will be generally horizontal when such notch is fitted over the first-layer log 10 on which it rests. This is best seen in FIG. 5B, wherein a rough notch 81 cut into the large end L of the illustrated second-layer log 20 is dimensioned such that, when it is fitted over the large end L of the illustrated first-layer log 10, the large end L of the second-layer log 20 is lowered a certain distance 83 and into a position wherein the flat bottom surface 25 of the illustrated second-layer log 20 is generally horizontal.

Where rough notches are used, it may be particularly desirable to cut a rough notch into at least one end of each second-layer log such that the bottom surfaces of all of the second-layer logs in the structure will lie generally in a common horizontal plane when each second-layer rough notch is fitted over the first-layer log on which it rests. As would be obvious to log builders having ordinary skill, this will allow the builder to bring all of the second-layer logs to their final positions by lowering both ends of each second-layer log the same distance, as is discussed below.

It would be obvious to those skilled in the art of log building that rough notches can be used at various stages during the building process to accomplish a variety of goals. These reasons include: making the gap between adjacent pairs of logs more uniform; separating vertically adjacent pairs of logs by a gap of a certain vertical dimension; stabilizing the logs; helping to influence the shoulder heights of the logs; and making certain logs or portions of logs horizontal or level. Since the many of the possibilities are well known to those skilled in the relevant art, they will not be discussed in further detail. Furthermore, it would be obvious to those skilled in the art of designing or building log structures that the present invention can be practiced without using any rough notches. However, as skilled artisans in the instant field would appreciate, rough notches can be used quite advantageously in many ways when building structures according to the present invention.

A third-layer of logs is positioned in a crosswise stack above the second-layer of logs. The third-layer is positioned such that each end region of each third-layer log rests above a second-layer log. Commonly, the third-layer of logs is positioned such that each end region of each third-layer log actually rests on a second-layer log. For example, the third-layer logs 30 illustrated in FIG. 1 are positioned such that each end region of each third-layer log 30 rests on one end region of a second-layer log 20. However, each end region of each third-layer log need not be contiguous with the second-layer log below. For example, it may be desirable to raise one or both ends of certain third-layer logs. In such cases, a shim or the like may be placed between any such end region and the log below. Furthermore, it is not necessary that the third-layer logs be directly supported by second-layer logs. For example, in one aspect of the present invention, one or more third-layer logs are held by positioning devices (such as those discussed above) that can be secured to the ends of a log. Such devices may allow the user to adjust the position of each log vertically, horizontally, and rotationally.

Each third-layer log lies above and extends alongside an adjacent first-layer log to define a pair of adjacent first-layer and third-layer logs. For example, the bottom two logs in the south wall S of the structure illustrated in FIG. 1 form an adjacent pair of first-layer and third-layer logs. In most cases, it will be preferable if each third-layer log lies directly above the adjacent first-layer log, such as where vertical walls are to be formed. In such cases, the third-layer logs are optimally positioned such that the longitudinal axes of each pair of adjacent first-layer and third-layer logs lie generally in a common plane that is vertical. In other words, the third-layer logs are positioned such that each third-layer log lies generally plumb above an adjacent first-layer log. For example, each third-layer log 30 illustrated in FIG. 1 lies generally plumb above an adjacent first-layer log 10. If desired, though, a structure with sloped walls could be built according to the present invention. In such a structure, the third-layer logs would be positioned such that the longitudinal axes of adjacent first-layer and third-layer logs lie generally in a common plane that is sloped to the vertical. Variations of this nature would be obvious to those skilled in the art of building or designing log structures.

A first gap is formed between each pair of adjacent first-layer and third-layer logs. The upper and lower boundaries of each first gap are formed respectively by the bottom surface of a third-layer log and the top surface of an adjacent first-layer log. This is perhaps best seen with reference to FIG. 6A, wherein the illustrated first gap 31 has an upper boundary defined by the bottom surface 35 of the adjacent third-layer log 30 and a lower boundary defined by the top surface 17 of the adjacent first-layer log 10. The number of first gaps in a structure will depend on the layout of the structure. For example, the four-walled structure shown in FIG. 1 has two first gaps 31, whereas an eight-walled structure built according to the configuration typified in FIG. 3 would have four first gaps (not shown).

Where the third-layer logs are positioned directly atop the second-layer logs, the height of each first gap will typically vary along the length of the adjacent first-layer and third-layer logs. For example, the height of each first gap will commonly be greater near the end region of each third-layer log that sits atop the large end region of a second-layer log. This is best seen with reference to FIG. 6A, wherein the height of the illustrated first gap 31 is greatest near the small end region S of the adjacent third-layer log 30.

It is preferable to adjust the relative positions of each pair of adjacent first-layer and third-layer logs such that each first gap has a height that is substantially the same at the small and large end regions of the adjacent third-layer log. That is, the relative positions of adjacent logs are adjusted such that the height of each first gap is more uniform from end to end. As is discussed below, by making the height of each first gap more uniform from end to end, one can minimize the wall height that is lost when grooves are cut into the bottom surfaces of each third-layer log. This can be accomplished in different ways.

Figure 6A:
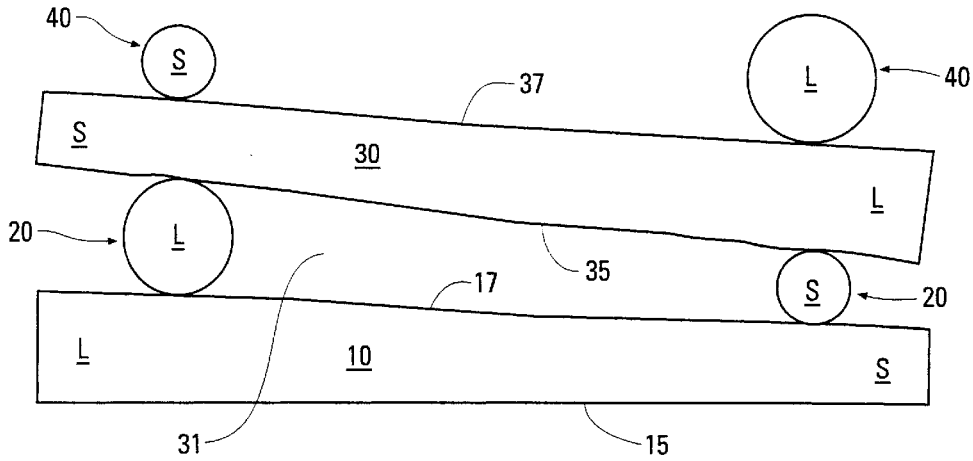
FIG. 6A is a side view schematically illustrating four layers of logs that have been stacked in accordance with one embodiment of the present invention.
Figure 6B:
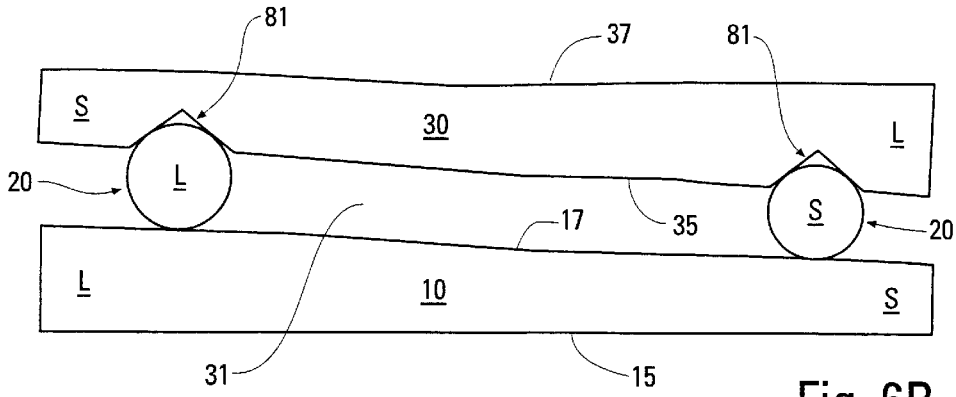
FIG. 6B is a side view of three layers of logs that have been stacked in accordance with an alternate embodiment of the present invention.

In one aspect of the present invention, a rough notch is cut into at least one end region of each third-layer log. These notches may be cut such that each first gap has a substantially similar height at the small and large end regions of the adjacent third-layer log when each third-layer rough notch is fitted over the second-layer log on which it rests. For example, the height of the first gap 31 shown in FIG. 6A is greater near the small end region S of the illustrated third-layer log 30 than it is near the large end region L of that log. In this case, it would be desirable to cut a rough notch into the small end region S of the illustrated third-layer log 30 such that the first gap 31 will have a substantially similar height at the small S and large L end regions of this third-layer log when the rough notch is fitted over the illustrated large end region L of a second-layer log.

In another aspect of the invention, positioning devices could be used to make the height of each first gap more uniform from end to end. As discussed above, such devices may allow the user to adjust the position of each log vertically, horizontally, and rotationally. Thus, it would be possible to adjust the relative positioning of adjacent first-layer and third-layer logs such that the height of each first gap is substantially the same at the large and small end regions of the adjacent third-layer log.

In a preferred aspect of the present invention, the relative positioning of each pair of adjacent first-layer and third-layer logs is adjusted such that all of the first gaps in the structure have a maximum height that is substantially the same. This may be done by cutting appropriately dimensioned rough notches into the third-layer logs. Alternatively, positioning devices such as those discussed above may be used to adjust the relative positions of each adjacent pair of first-layer and third-layer logs such that all of the first gaps have a maximum height that is substantially the same. As is discussed below, this will minimize the amount of wall height that will ultimately be lost when a groove is cut into the bottom surface of each third-layer log.

It is well known by those skilled in the relevant art that it can be advantageous to orient logs in the same wall such that vertically adjacent logs have their small and large ends inversely oriented. For example, each pair of adjacent first-layer 10 and third-layer 30 logs illustrated in FIG. 1 have their small S and large L ends inversely oriented. Likewise, each pair of adjacent third-layer 30 and fifth-layer 50 logs have their small S and large L ends inversely oriented. The same is true of each adjacent pair of fifth-layer 50 and seventh-layer 70 logs. It can be advantageous to repeat such a pattern all the way up each wall in a structure since it tends to produce walls that are level. It would be obvious to those of ordinary skill in the art of log building that other variations of this pattern would also be acceptable. For example, the bottom two logs in a wall could both have their small ends facing the same direction, while the small ends of the third and fourth logs in that wall could be facing an opposite direction, and so on. Furthermore, it would be obvious to those of ordinary skill in the instant art that the present invention can be practiced without adhering to any such pattern.

It is also well known by skilled artisans in the present field that logs in adjoining walls can be oriented to certain advantageous patterns to produce a structure wherein adjoining walls are approximately level. Optimally, the end regions of the logs that form each corner are oriented such that, beginning at the bottom of a corner and moving toward the top, they exhibit a small end, small end, large end, large end pattern (a "SSLL" pattern). For example, in FIG. 1, the ends of the logs at the southeast corner are oriented such that, from the bottom up, they form a small end S, small end S, large end L, large end L pattern. Of course, the ends of the bottommost two logs in a given corner need not both be small ends, nor must they both be large ends. For example, an obvious variation on the SSLL pattern would be a pattern that goes SLLSSLL and so on. Likewise, a LSSLLSS pattern would be possible. Since this pattern is well known to those of ordinary skill in the instant art, it will not be discussed in further detail. Furthermore, as would be obvious to those having ordinary skill in the art of log building, the present invention can be practiced without orienting the logs in adjoining walls according to any such pattern.

A fourth layer of logs is then positioned in a crosswise stack above the third-layer of logs. The fourth layer is positioned such that each end region of each fourth-layer log rests above a third-layer log. Commonly, the fourth layer of logs is positioned such that each end region of each fourth-layer log actually rests on a third-layer log. For example, the fourth-layer logs illustrated in FIG. 1 are positioned such that each end region of each fourth-layer log 40 rests on one end region of a third-layer log 30. However, each end region of each fourth-layer log need not be contiguous with the third-layer lob below. For example, it may be desirable to raise one or both ends of certain fourth-layer logs. In such cases, a shim or the like may be placed between any such end region and the log below. Furthermore, it is not necessary that the fourth-layer logs be directly supported by the third-layer logs. For example, in one aspect of the present invention, one or more fourth-layer logs are held by positioning devices (such as those discussed above) that can be secured to the ends of a log. Such devices may allow the user to adjust the position of each log vertically, horizontally, and rotationally.

Each fourth-layer log lies above and extends alongside an adjacent second-layer log to define a pair of adjacent second-layer and fourth-layer logs. For example, the bottom two logs in the east wall E of the structure illustrated in FIG. 1 form an adjacent pair of second-layer 20 and fourth-layer 40 logs. In most cases, it will be preferable if each fourth-layer log lies directly above the adjacent second-layer log, such as where vertical walls are to be formed. In such cases, the fourth-layer logs are optimally positioned such that the longitudinal axes of each pair of adjacent second-layer and fourth-layer logs lie generally in a common plane that is vertical. That is, such that each fourth-layer log lies generally plumb above an adjacent-second-layer log. For example, each fourth-layer log 40 illustrated in FIG. 1 lies plumb above an adjacent second-layer log 20. If desired, though, a structure with sloped walls could be built according to the present invention. In such a structure, the fourth-layer logs would be positioned such that the longitudinal axes of adjacent second-layer and fourth-layer logs lie generally in a common plane that is sloped to the vertical. Variations of this nature would be obvious to those having ordinary skill in the art of log building.

A second gap is formed between each pair of adjacent second-layer and fourth-layer logs. The upper and lower boundaries of each second gap are formed respectively by the bottom surface of a fourth-layer log and the top surface of an adjacent second-layer log. This is perhaps best seen with reference to FIG. 5A, wherein the illustrated second gap 41 has an upper boundary defined by the bottom surface 45 of the adjacent fourth-layer log 40 and a lower boundary defined by the top surface 27 of the adjacent second-layer log. The number of second gaps in a structure will depend on the layout of the structure. For example, the four-walled structure shown in FIG. 1 has two second gaps 41, whereas an eight-walled structure built according to the configuration typified in FIG. 3 would have four second gaps (not shown).

Where the fourth-layer logs are positioned directly atop the third-layer logs, the height of each second gap will typically vary along the length of the adjacent second-layer and fourth-layer logs. For example, the height of each second gap will commonly be greater near the end region of each fourth-layer log that sits atop the large end region of a third-layer log. This is best seen with reference to FIG. 5A, wherein the height of the illustrated second gap 41 is greatest near the large end region L of the adjacent fourth-layer log 40.

It is preferable to adjust the relative positions of each pair of adjacent second-layer and fourth-layer logs such that each second gap has a height is substantially the same at the small and large end regions of the adjacent fourth-layer log. That is, such that the height of each second gap is more uniform from end to end. As is discussed below, by making the height of each second gap more uniform from end to end, one can minimize the wall height that is lost when grooves are cut into the bottom surfaces of each fourth-layer log. This can be accomplished in different ways.

In one aspect of the invention, a rough notch is cut into at least one end region of each fourth-layer log. These notches may be cut such that each second gap has a substantially similar height at the small and large end regions of the adjacent fourth-layer log when each fourth-layer rough notch is fitted over the third-layer log on which it rests. For example, the height of the second gap 41 illustrated in FIG. 5A is greater near the large end L of the illustrated fourth-layer log 40 than it is near the small end S of that log. In this case, it would be desirable to cut a rough notch into the large end L of the illustrated fourth-layer log 40 such that the height of the second gap 41 will be substantially the same at both ends of the fourth-layer log 40 when this notch is fitted over the illustrated large end L of a third-layer log 30.

In another aspect of the present invention, positioning devices could be used to make the height of each second gap more uniform from end to end. As discussed above, such devices may allow the user to adjust the position of each log vertically, horizontally, and rotationally. Thus, it would be possible to adjust the relative positioning of adjacent second-layer and fourth-layer logs such that the height of each second gap is substantially the same at the large and small end regions of the adjacent fourth-layer log.

In a preferred aspect of the present invention, the relative positioning of each pair of adjacent second-layer and fourth-layer logs is adjusted such that all of the second gaps in the structure have a maximum height that is substantially the same. This may be done by cutting appropriately dimensioned rough notches into the fourth-layer logs. Alternatively, positioning devices such as those discussed above may be used to adjust the relative positions of each adjacent pair of second-layer and fourth-layer logs such that all of the second gaps have a maximum height that is substantially the same. As discussed below, this will minimize the amount of wall height that will ultimately be lost when a groove is cut into the bottom surface of each fourth-layer log.

Log structures can be built to virtually any height. While the positioning of four layers of logs has been described, it would be obvious to those having ordinary skill in the art of log building that additional layers of logs could be added in accordance with the foregoing discussion. For example, FIG. 1 illustrates a log structure wherein several additional layers of logs have been stacked according to one aspect of the present invention. The illustrated structure includes additional fifth-layer logs 50, sixth-layer logs 60, seventh-layer logs 70, and eighth-layer logs 80 that have been added in the same manner as was discussed with reference to the first four layers of logs.

In traditional log-by-log building, every log in a layer is fully processed and finally fitted in its permanent position before any of the logs in the layers above are processed. Thus, at any given time, the builder is only scribing or cutting the logs of the layer that is being added. For example, when constructing a four-walled structure such as that illustrated in FIG. 1, the builder would only be working on two logs at any given time. Unfortunately, the time requirements of the traditional methodology are well known to those who build handcrafted log structures. With the present invention, it would be possible to scribe the long grooves and final notches for all of the logs in the entire structure at the same time. Likewise, it would be possible to cut the long grooves and final notches into all of the logs in the structure at the same time. For example, in building a four-walled structure with nine logs in each wall, the builders could scribe the long grooves and final notches for all 36 logs at the same time. Likewise, once all 36 logs were scribed, the builders could simultaneously cut the long grooves and final notches for all 36 logs.

After stacking four layers of logs that are to be built according to the present invention, it is possible to determine the cuts that will ultimately be made in such logs. The present invention can, of course, be used to build structures having more than four layers. However, discussion herein typifies use of the present invention to build the bottommost four layers in a structure.

Figure 10A:
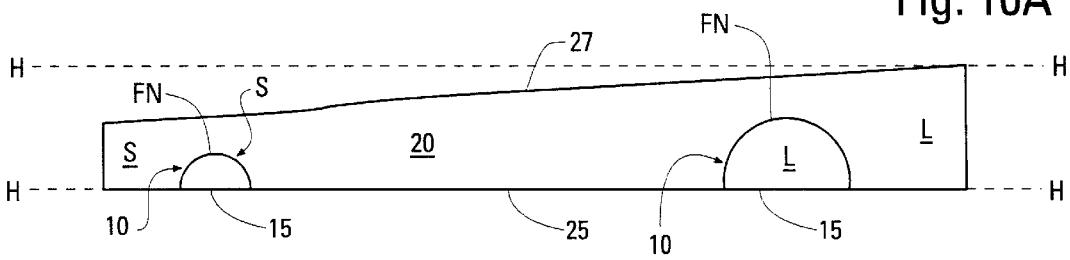
FIG. 10A is a side view of a second-layer log with final notches cut according to one aspect of the present invention.
Figure 10B:
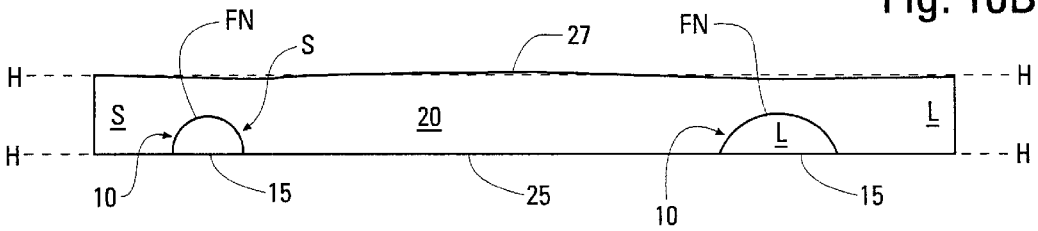
FIG. 10B is a side view of a second-layer log with final notches cut according to another aspect of the present invention.
Figure 10C:
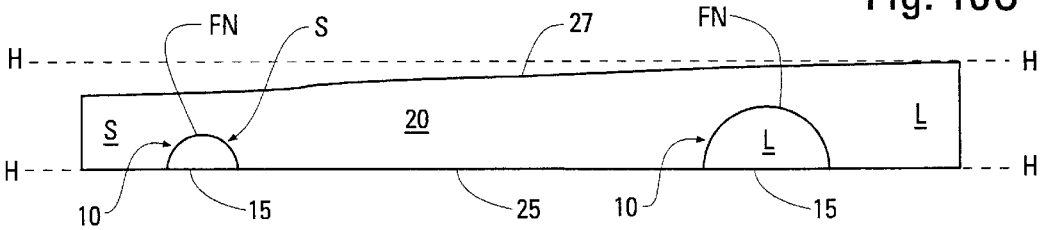
FIG. 10C is a side view of a second-layer log with final notches cut according to an alternate aspect of the present invention.
Figure 11:
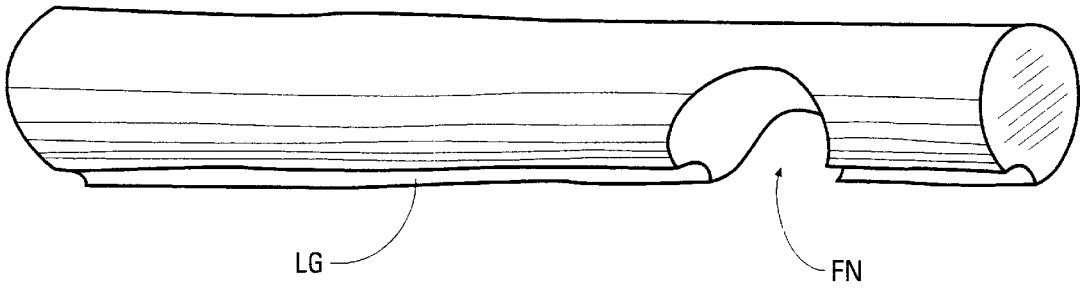
FIG. 11 is a perspective view of a log with a long groove and one final notch cut according to one aspect of the present invention.

Two different types of cuts will ultimately be made in most of the logs (after the dimensions for such cuts have been determined in accordance with the present invention). A groove (or "long groove") will be cut along the bottom length of many logs, and a final notch will be cut into both ends of most logs. FIG. 11 illustrates a log having a simple concave long groove cut LG along its bottom length (this is typical of one type of long groove that may be cut for any of the logs) and one final notch FN (although logs would typically have a final notch in both ends). FIGS. 10A–10C illustrate a second-layer log having a final notch FN (such as is typical of the final notches cut in the logs of any layer) cut in each end. It will be understood that the discussion below of long grooves and final notches refers only to those logs that require such cuts. That is, the discussion below should not be interpreted to mean that each log in a structure built according to the present invention must have a long groove cut and final notch cuts. As would be obvious to those of ordinary skill in the art of log building, it is not necessary to make such cuts in every log in a structure. The traditional manner in which the configurations of long groove cuts and final notch cuts are determined will now be discussed in turn.

The long groove cuts that will ultimately be made along the bottom length of each log are configured such that the top and bottom surfaces of each pair of adjacent logs will be engaged as completely as possible along their length when each log is fitted into its final position. A groove cut will be made along the bottom length of the uppermost log in each pair of adjacent logs. A groove cut is commonly made along the bottom length of every log in a structure except the sill logs. It is typically not necessary to cut a groove in the bottom length of the sill logs since the bottom surfaces of these logs will not engage the top surface of other logs.

Each groove cut that will be made along the bottom length of a log should match the contour of the top surface of the adjacent log below. Any suitable method for determining the configuration of a long groove cut could be used in accordance with the present invention. Commonly, a marking instrument similar to an inside caliper is used to mark lines along the bottom length of each log that will have a long groove. Ultimately, the wood below (in other words, between) these lines will be removed to form a long groove.

Figure 7:
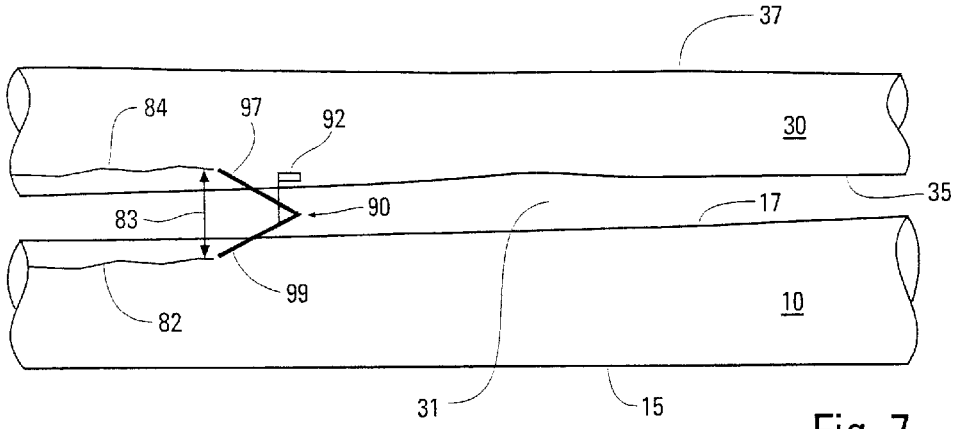
FIG. 7 is a side view illustrating the determination of a long groove cut according to one aspect of the present invention.

The caliper (or "scriber") typically has an upper arm and a lower arm, each bearing a marking point. For example, FIG. 7 illustrates a simple scriber 90 having two spaced-apart arms. The illustrated scriber 90 has a level indicator 92 that is used to keep the marking points of the scriber plumb. That is, in a position where the tips of the upper arm 97 and the lower arm 99 are vertically aligned. Commonly, each scriber arm bears a marking point (such as a pencil) that is used to mark the dimensions of the groove cuts that will eventually be made.

In marking (or "scribing") each groove cut with such an instrument, the upper 97 and lower 99 marking points of the scriber are set a certain distance apart. This distance is commonly referred to as the "scribe setting". In traditional log-by-log building, builders typically use different scribe settings for different logs in the same layer. However, as is discussed below, the same scribe setting is used for each of the logs in the same layer when building according to the present invention.

The method in which long grooves may be scribed is best seen with reference to FIG. 7, wherein a pair of adjacent first-layer 10 and third-layer 30 logs are illustrated. After determining the scribe setting 83 that will be used for all of the third-layer logs (as is discussed below), the builder brings both tips of the scriber 90 into engagement with the illustrated pair of adjacent logs while holding the scriber 90 in a plumb position (such that the tips of the upper 97 and lower 99 arms are vertically aligned). In other words, while holding the scriber plumb, the scriber 90 is moved into a position where the tip of the upper arm 97 engages a surface of the illustrated third-layer log 30 above the adjacent first gap 31, and the tip of the lower arm 99 engages a surface of the illustrated first-layer log 10 below that first gap 31. The tips of the scriber are dragged along the length of the illustrated first-layer 10 and third-layer 30 logs, all the while keeping the scriber in a plumb position. This forms a line 84 along the length of the third-layer log 30 and a line 82 along the length of the first-layer log 10. The scriber lines will commonly be serpentine or wavelike since they match the unique contour (or "topography") of each log. The scriber may be dragged along the surfaces that will form the inside wall of the structure, the outside wall of the structure, or both. Preferably, the scriber is dragged along both the inside and outside surfaces so a line is marked on both sides of each log that is to have a long groove. The wood below (that is, between) each of these lines will ultimately be removed to form a long groove in each log.

A variety of differently shaped long grooves can be cut into the bottom surface of each third-layer log. A simple long groove may comprise a concave channel cut along the bottom length of each log. For example, U.S. Pat. No. 2,525,659, issued to Edson et al. (the teachings of which are herein incorporated by reference), shows a particular use of concave long grooves. One popular type of long groove that is commonly referred to as the "double-cut long groove" comprises two concave channels running side-by-side along the bottom length of each log. Since selecting the appropriate types of long grooves to use in a given structure would be obvious to those having ordinary skill in the art of log building, it will not be discussed in further detail. Builders commonly use a chainsaw to cut each long groove. In some cases, though, a chisel, planer, or sander may be used to perfect the cut.

A final notch cut will eventually be made in both end regions of most logs. As would be obvious to those of ordinary skill in the instant art, final notches are typically unnecessary for the first-layer sill logs since they are not fitted over other logs.

The configuration of each final notch cut that will be made should reflect the contour of the top surface of the log over which it will ultimately be fitted. The configuration of each final notch cut is commonly determined using a scriber in much the same was as was discussed above with reference to long grooves. In marking each final notch cut, the upper and lower marking points of the scriber are set to the desired scribe setting. In traditional log building, builders typically use different scribe settings for the final notches of different logs in the same layer. However, as is discussed below, the same scribe setting is used for every log in the same layer when building according to the present invention.

Figure 9:
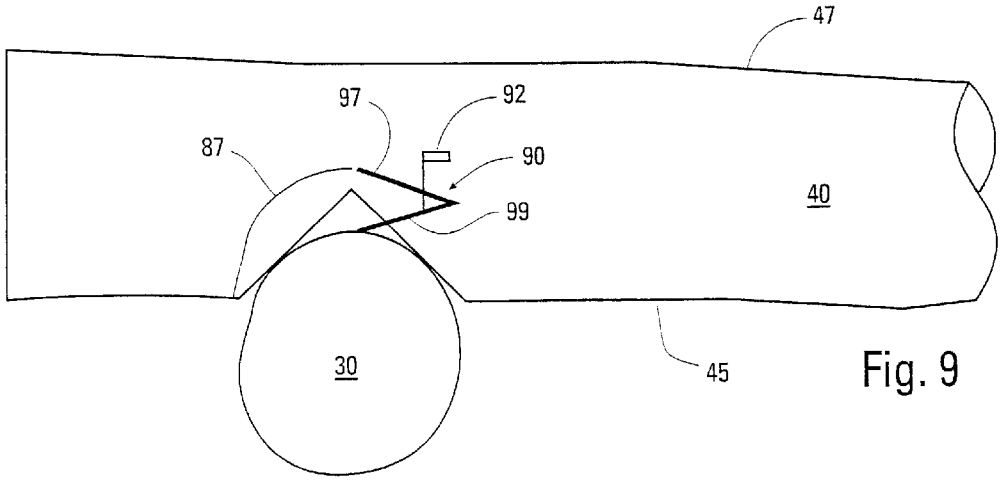
FIG. 9 is a side view illustrating the determination of a final notch according to one aspect of the present invention.
Figure 8:
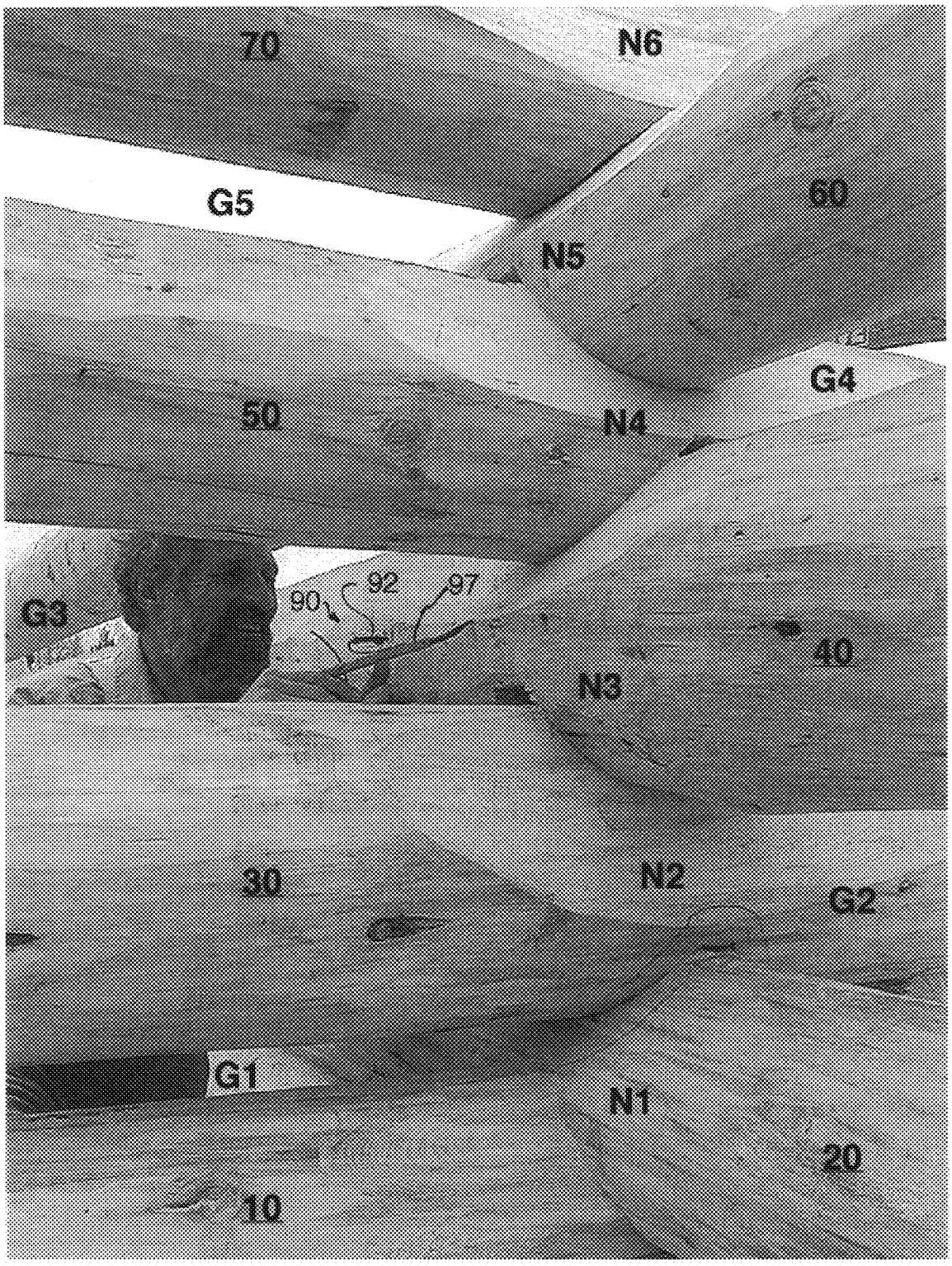
FIG. 8 is a perspective view illustrating the determination of a final notch cut according to one aspect of the present invention.

The method in which final notches are traditionally scribed is perhaps best seen with reference to FIG. 8 or 9. FIG. 8 illustrates a builder in the process of scribing the final notch for a fourth-layer log 40. The scriber 90 is illustrated in a plumb position wherein the tip of the upper arm 97 is engaged with a surface of the illustrated fourth-layer log 40 and the tip of the lower arm 99 is engaged with the illustrated third layer log 30. The tips of the scriber are then dragged along the intersection of these two logs to form an outline of the final notch that will be cut into the illustrated fourth layer log 40. FIG. 9 also shows a scriber 90 in a plumb position wherein the tip of the upper arm 97 is engaged with a surface of the illustrated fourth-layer log 40 and the tip of the lower arm 99 is engaged with the illustrated third-layer log 30. The tips of the scriber are dragged over these logs (while holding the scriber plumb) so as to form an outline 87 of the final notch cut that will ultimately be made in the illustrated fourth-layer log 40. This outline 87 will match the semi-circular contour of the top of the illustrated third-layer log 30. Since this traditional method of scribing final notches would be obvious to those having ordinary skill in the art of log building, it will not be discussed in further detail.

A maximum height of the first gaps in the structure is determined. That is, the builder searches all of the first gaps in the structure to determine the single location (or locations) where the height of a first gap is the greatest. Since each naturally-shaped log has a unique taper and surface contour, there will typically be only one location between each pair of adjacent first-layer and third-layer logs where the height of the first gap formed therebetween is greatest. In other words, there will typically be one location along the length of the first gap in each wall where the height of that first gap is greatest. For example, there is a single location (not shown) along the first gap 31 in the north wall N of the structure shown in FIG. 1 where the height of that first gap 31 is greatest. The builder locates and measures the greatest height found in each of the first gaps in the structure. The builder then determines which of these measurements is largest, and this measurement defines the maximum height of the first gaps in the structure. For example, the maximum height of first gaps 39 in the structure shown in FIG. 1 is located in the south wall S of the structure. In other words, the maximum height of the first gaps 39 in the structure is equal to the greatest separation between any pair of adjacent first-layer and third-layer logs in the entire structure.

The builder determines a groove cut that will leave a bottom surface of each third-layer log separated from a top surface of an adjacent first-layer log by a first vertical distance that is substantially the same at all points along the first gaps and is at least as great as the maximum height of the first gaps that was determined above. That is, the builder determines the configuration of each third-layer groove cut such that if the third-layer grooves were cut and the third-layer logs were restacked without final notches, then the bottom surface of each stacked third-layer log would be separated from the top surface of an adjacent first-layer log by a first vertical distance that would be substantially the same at every point along any one of the first gaps in the structure. This first vertical distance is at least as great as the maximum height of the first gaps that was determined above.

The configuration of each third-layer long groove cut can be determined using any suitable measuring or marking means. Commonly, this is accomplished by scribing long groove lines on each of the third-layer logs in the manner discussed above. Where the dimensions of the long groove cuts are determined by scribing, every third-layer log in the entire structure is scribed using the same scriber setting. This scriber setting is equal to the first vertical distance, which is at least as great as the maximum height of the first gaps that was determined above.

By determining the configurations of the third-layer long groove cuts such that this first vertical distance is at least as great as the maximum height of the first gaps, the builder is assured that each pair of adjacent first-layer and third-layer logs will be engaged all the way along the length of the adjacent first-layer and third-layer logs when the logs are finally fitted into a permanent position. Preferably, the first vertical distance is slightly larger than the maximum height of the first gaps, as this will assure a more substantial engagement between each adjacent pair of first-layer and third-layer logs when fitted into a permanent position. Excellent results have been achieved using a first closure distance that is about one-quarter of one inch greater than the maximum height of the first gaps.

A maximum height of the second gaps in the structure is determined. That is, the builder searches all of the second gaps in the structure to determine the location (or locations) where the height of a second gap is greatest. In many cases, there will be only one location between each pair of adjacent second-layer and fourth-layer logs where the height of the second gap formed therebetween is greatest. Since each naturally-shaped log will have a unique taper and surface contour, there will typically be only one location between each pair of adjacent second-layer and fourth-layer logs where the height of the second gap formed therebetween is greatest. In other words, there will typically be one location along the length of the second gap in each wall where the height of that second gap is greatest. For example, there is one location (not shown) along the west wall W of the structure illustrated in FIG. 1 where the height of that second gap 41 is greatest. The builder locates and measures the greatest height found in each of the second gaps in the structure. The builder then determines which of these measurements is largest, and this measurement defines the maximum height of the second gaps in the structure. For example, the maximum height of the second gaps 49 in the structure shown in FIG. 1 is located in the east wall E of the structure. In other words, the maximum height of the second gaps 49 in the structure is equal to the greatest separation between any pair of adjacent second-layer and fourth-layer logs in the entire structure.

The builder determines a groove cut that will leave a bottom surface of each fourth-layer log separated from a top surface of an adjacent second-layer log by a second vertical distance that is substantially the same at all points along the second gaps and is at least as great as the maximum height of the second gaps that was determined above. That is, the builder determines the configuration of each fourth-layer groove cut such that if the fourth-layer grooves were cut and the fourth-layer logs were restacked, then the bottom surface of each stacked fourth-layer log would be separated from the top surface of an adjacent second-layer log by a second vertical distance that would be substantially the same at every point along any one of the second gaps in the structure. This second vertical distance is at least as great as the maximum height of the second gaps that was determined above.

The configuration of each fourth-layer long groove cut can be determined using any suitable measuring or marking means. Commonly, this is accomplished by scribing long groove lines on each of the fourth-layer logs in the same way that was discussed above. Where the dimensions of the long groove cuts are determined by scribing, every fourth-layer log in the entire structure is scribed using the same scriber setting. This scriber setting is equal to the second vertical distance, which is at least as great as the maximum height of the second gaps determined above.

By determining the configurations of the fourth-layer long groove cuts such that this second vertical distance is at least as great as the maximum height of the second gaps, the builder is assured that each pair of adjacent second-layer and fourth-layer logs will be engaged all the way along the length of the adjacent second-layer and fourth-layer logs when fitted into a permanent position. Preferably, the second vertical distance is slightly greater than the maximum height of the second gaps, as this will assure a more substantial engagement between each adjacent pair of second-layer and fourth-layer logs when fitted into a permanent position. Excellent results have been achieved using a second closure distance that is about one-quarter of one inch greater than the maximum height of the second gaps.

If additional layers have been added to a structure (as will typically be the case), then a maximum gap determination and a groove cut determination is made for the logs of each additional layer in the same manner as was discussed above with reference to the logs of the first four layers. For example, a four-walled structure having six layers would have a third gap formed between each adjacent pair of third-layer and fifth-layer logs. A maximum height of the third gaps in the structure would be determined in the same manner as was discussed with reference to the first and second gaps. A long groove cut would then be determined for each fifth-layer log in the same manner as was discussed with reference to the third-layer and fourth-layer logs. This would be repeated for as many additional layers as have been added to the structure.

The builder determines a final notch cut that will lower both end regions of each second-layer log by a first drop distance when each second-layer final notch is fitted over the first-layer log on which it rests. This first drop distance will be equal to the distance by which the builder wishes to lower both ends of each second-layer log in the structure such that each second-layer log will be in a final position when each second-layer final notch is fitted over the first-layer log on which it rests. Where scribing is used to mark the second-layer final notch cuts, the first drop distance will be equal to the scriber setting used to mark all of the second-layer notches.

Once the first drop distance is determined, a dimension of the third-layer and fourth-layer final notch cuts will be fixed. Where scribing is used to mark the third-layer and fourth-layer final notch cuts, the final notch scribe settings for every log in the third layer will be fixed once the first drop distance is determined. Likewise, the final notch scribe settings for every log in the fourth layer will be fixed once the first drop distance is determined. Moreover, where additional layers have been added according to the present invention, a dimension of the final notch cuts for each additional layer will also be fixed once the first drop distance has been determined. Again, where scribing is used to mark final notches, once the first drop distance is set, the final notch scribe settings for each additional layer will be fixed.

This can be illustrated by the equation: $N_2=G_1-N_1$; where $N_1$ is the first drop distance (where scribing is used, this will be the scriber setting for the second-layer final notches); where $G_1$ is the first vertical distance (where scribing is used, this was the scriber setting used for the third-layer long grooves); and where N2 is the second drop distance (where scribing is used, this will be the scriber setting for the third-layer final notches). Thus, since we already know $G_1$ (the first vertical distance), it can be seen that once the first drop setting is determined, the second drop setting becomes fixed as well. In fact, the drop settings for other layers above become fixed as well.

This equation can be expanded (as will be discussed later). Alternatively, it can be applied from the bottom up to determine the drop distances of each layer of logs above. This can be done because we already know the first vertical distance, and the second vertical distance, and so on (i.e. the distance required to close the gaps between every pair of vertically adjacent layers). For example, the equation could be used next to determine the third drop distance (where scribing is used, this will be the scriber setting used for the fourth-layer final notches) as follows: $N_3=G_2-N_2$; where $N_2$ is the second drop distance (where scribing is used, it is the scriber setting for the third-layer final notches); where $G_2$ is the second vertical distance (where scribing is used, this was the scriber setting used for the fourth-layer long grooves); and where $N_3$ is the third drop distance (where scribing is used, this will be the scriber setting for the fourth-layer final notches). Since we already know $G_2$ (the second vertical distance), it can be seen that the selection of the first drop setting has also fixed the third drop setting. Likewise, the drop settings for other layers above become fixed.

The builder determines the first drop distance according to the distance both ends of each second-layer log should be lowered to bring them into a final position when each second-layer final notch is fitted over the first-layer log on which it rests. That is, the first drop distance is determined in light of how far all of the second-layer logs should be dropped to bring them to an appropriate final position. The builder has some flexibility in determining the final position into which the second-layer logs will be lowered. There are different final positions into which the second-layer logs might be moved by lowering both ends of each second-layer log the same distance.

In the scenario typified herein (where the first-layer and second-layer logs are sill logs with planar bottom surfaces), the builder will determine a final notch cut that will lower both end regions of each second-layer log by a first drop distance and into a final position wherein a bottom surface of each second-layer log is approximately flush with (or just parallel to, if desired) a bottom surface of each first-layer log when each second-layer final notch is fitted over the first-layer log on which it rests. This is best seen with reference to FIG. 4, wherein there are shown two second-layer logs 20 in a final position wherein the bottom surface 25 of each second-layer log 20 is flush with the bottom surface 15 of each first-layer log 10.

In scenarios where the first layer of logs (that is, the first layer of logs added in accordance with this invention) is not the bottommost layer in a wall, the second-layer logs will typically be lowered into a final position wherein the bottom surface of each second-layer log engages the top surface of an adjacent sublayer log. In such scenarios, the second layer of logs will have been positioned above a sublayer of logs in a crosswise stack wherein each end region of each second-layer log rests above a sublayer log. In this case, each second-layer log will have been positioned to lie above and extend alongside an adjacent sublayer log to define a pair of adjacent sublayer and second-layer logs, whereby a gap is formed between each such pair of adjacent sublayer and second-layer logs.

While the precise orientation of the sublayer logs will obviously vary, builders commonly orient logs in one of three basic ways: (1) such that the top surface of the log is generally horizontal; (2) such that the bottom surface of the log is generally horizontal; and (3) such that the longitudinal axis of the log is generally horizontal. These three scenarios are best seen with reference to FIGS. 10A–10C. FIG. 10A illustrates a second-layer log 20 in a final position wherein the bottom surface 25 of the illustrated log is generally aligned with a horizontal axis H. The second-layer logs would commonly be lowered into a final position of this nature when the top surface of the adjacent sublayer logs would be horizontal when finally fitted. FIG. 10B illustrates a second-layer log 20 in a final position wherein the top surface 27 of the illustrated log is generally aligned with a horizontal axis H. This would commonly be appropriate when the bottom surface of each of the adjacent sublayer logs would be horizontal when finally fitted. FIG. 10C illustrates a second-layer log 20 in a final position wherein a longitudinal axis of the illustrated log is generally aligned with a horizontal axis H. This would commonly be appropriate when the longitudinal axis of each of the adjacent sublayer logs will be horizontal when finally fitted. Determinations of how each second-layer log should be finally positioned in accordance with the foregoing would be obvious to those of skill in the art, and will not be discussed in further detail.

The builder determines a final notch cut that will lower both end regions of each third-layer log by a second drop distance that is approximately equal to said first vertical distance less said first drop distance when each third-layer final notch is fitted over the second-layer log on which it rests. As was discussed with reference to the equation above, the second drop distance will be fixed once the first drop distance is determined (since the first vertical distance is known).

In one aspect of the invention, the builder then determines a final notch cut that will lower both end regions of each fourth-layer log by a third drop distance that is approximately equal to said second vertical distance less said second drop distance when each fourth-layer final notch is fitted over the third-layer log on which it rests. As was discussed with reference to the equation above, the third drop distance will also be fixed once the first drop distance is determined (since we know the first vertical distance and the second vertical distance).

If additional layers of logs have been added to a structure, then a final notch determination is made for the logs of each additional layer in the same manner as was discussed above with reference to the logs of the first four layers. For example, a four-walled structure having six layers would have a third gap formed between each pair of adjacent third-layer and fifth-layer logs. The maximum height of the third gaps would be determined in the same manner as was discussed with reference to the first and second gaps. Likewise, a third vertical distance of the fifth-layer long groove cuts would be determined in the same manner as was discussed with reference to the third-layer and fourth-layer long groove cut determinations. Finally, the builder would determine a final notch cut that will lower both end regions of each fifth-layer log by a fourth drop distance that is approximately equal to said third vertical distance less said third drop distance when each fifth-layer final notch is fitted over the fourth-layer log on which it rests. The final notches for the additional layers can be determined in the same manner.

The equation discussed above can be expanded. The relationship governed by this equation is best seen with reference to FIG. 8. In the following expanded equation, it is assumed that all cut determination are made by scribing. Furthermore, the following equation is written assuming the lowest notch will be $N_2$ (that is x must be at least two in the following equation).

$$N_x=(-1)^{x-1}(N_1-G_1+G_2-G_3+G_4-G_5 \ldots G_{x-1})$$

Wherein $N_x$ is the scribe distance for all of the final notches in a given layer;

$N_1$ is the scribe distance for all of the second-layer final notches;

$G_1$ is the scribe distance for all of the long grooves in the second-layer logs;

$G_2$ is the scribe distance for all of the long grooves in the third-layer logs;

$G_3$ is the scribe distance for all of the long grooves in the fourth-layer logs;

$G_4$ is the scribe distance for all of the long grooves in the fifth-layer logs;

$G_5$ is the scribe distance for all of the long grooves in the sixth-layer logs; and so on;

$G_x$ is the scribe distance for all of the long grooves in the logs of layer x+1.

In one aspect of the present invention, the same long groove scribe setting can be used for all of the logs in the entire structure. In this case, the builder would use a long groove scribe setting slightly greater than the greatest gap found anywhere between any pair of adjacent logs in the structure. Once the second-layer final notches are scribed, the final notch scribe settings for the logs of all the remaining layers will be fixed. As seen in both forms of the equation above, the final notch setting for the second-layer logs can be equal to half of the groove setting. In such a case, the same final notch scribe setting (half the groove setting) can be used for all of the logs. For example, if the groove setting is 6" and the final notch setting for the second layer logs is 3", then the final notch setting for all the remaining logs will also be 3". This result would also be found using either of the two forms of the equation above.

Once the builder has determined all of the groove cuts and final notch cuts that are to be cut into the logs, the logs can be removed from the stack, and then cut. Since the dimensions of each cut have already been determined for all of the logs in the structure, it is possible for the builders to cut all of the logs at the same time. Furthermore, since the basic methods of cutting long grooves and final notches are well known to those of ordinary skill in the art of log building, the cutting process will not be discussed in further detail.

In an alternate aspect of the present invention, the builder could determine the greater of the maximum height of the first gaps and the maximum height of the second gaps. Whichever distance the builder finds to be greater would be the universal maximum height for those two gaps. This distance could be used as the scriber setting for the third-layer logs, for the fourth-layer logs, or for both layers of logs.

A variety of other embodiments are possible and will now be summarized:

Embodiment 1) Scribing can be simplified in the following way. If the widest gaps between layers of logs is held within a close tolerance (say the deviation in widest gap measurements is about ¼" for all layers in the stacked shell), then all long grooves can be easily scribed using one setting, instead of one setting per layer. As a consequence, if all the long grooves are scribed with one scribe setting, then all notches N2 and higher can either be scribed with one common setting (half the groove setting) or with two alternating settings. The formula: N6=G5−(G4−(G3−(G2−(G1−N1)))) condenses so that in all the layers above Layer 2, the corner notches are either scribed with a common setting equal to G−N1 (where N=½G, so the common setting equals ½G) or with two alternating settings equal to N2=G−N1 or N3=G−N2 (i.e., N3=N1). For example, if all the long grooves of the stacked shell were scribed with a scribe setting of 4¼" and N1 was scribed at 2⅛", then the notches of all the other layers would be scribed with just one scribe setting (i.e., 2⅛"=G−N1, where N1=½G, so the common setting=½G). This is the optimal situation if the widest gaps between each layer are quite close in measurement. Alternatively, if all the long grooves of the stacked shell were scribed with a scribe setting of 4¼", and N1 was scribed at 2", then the notches of all the other layers would be scribed with alternating settings of 2¼" and 2". N2=G−N1 equals 4¼" minus 2", which equals 2¼", N3=G−N2 equals 4¼" minus 2¼", which equals 2", and so on. One way to hold the widest gaps between layers of logs in close tolerance is to use an adjustable lifting device to raise the low corners (small gaps) of layers. This embodiment changes the basic unit of construction from the layer of logs to the entire stacked shell, that is, all the wall logs are logically a single unit.

Embodiment 2) The accelerated method can be used for buildings that are "chinked," a term that means they have no long-grooves, but have gaps between the lengths of the logs that are filled by a caulking, or chinking material. The invention will accelerate construction of chinked log buildings. Layers of rough-notched logs would be stacked, and then the corner notches would be scribed and cut, but no long grooves would be scribed or cut.

Embodiment 3) There are several alternatives for times when layers are final scribed. One would be to final scribe each layer of logs as soon as it is rough-notched, and before the next higher layer of rough-notched logs is applied to the stacked shell. This has the advantage of final scribing when the gaps have not been compressed or disturbed by the weight of higher layers. Another alternative is to final scribe the top layer of logs and remove them for cutting while the penultimate layer is scribed. This could continue as the stacked shell is dismantled. Or, some layers can be final scribed immediately after they are rough-notched, while other layers can wait until a later time to be final-scribed. It is obvious that further variations in the time and order in which layers are final scribed are possible.

Embodiment 4) Two or more layers could be stacked in the rough-notched condition, and then final scribed, and cut and fitted. This would be an advance over the one-log-at-a-time method. This would result in a log shell that could be completely fitted and assembled in the manufacturing yard. There may be occasions when it is useful to have the log shell standing completed in the manufacturing yard, for example, when a complex, or high, roof system must be built.

Embodiment 5) Log buildings that have more than one story of log walls can get tall and inconvenient to build. It is possible to build a top portion of the walls in a stacked shell that is separate from a bottom portion of the log walls, and then join them later. A variation on this would be to completely stack and final-scribe a bottom portion of the walls, and then remove the top two layers from the bottom portion, re-stack the top two layers on temporary supports and continue upwards, stacking the upper portion of the walls until complete.

Embodiment 6) Machine-peeled logs, or manufactured logs, could be used instead of hand-peeled logs with their fully natural shapes and sizes. This would make construction faster by reducing or eliminating the variety of log shapes and sizes. When the logs have less individuality and variety, then log selection is easier, controlling the widest gaps between layers is easier, and scribing is easier.

Embodiment 7) Every log in the structure would be suspended close to each other and stacked as if in a wall. The logs could be suspended from a hanger attached near each end. Each log end could be independently raised or lowered, and the log could be rotated around its longitudinal axis. There would be no need for rough notches. Positioning logs would be easy and quick, and a log's position could be adjusted even with other layers stacked above them. This would bring a level of flexibility unavailable until now because a rough-notched log cannot be rotated, and it is not easy to change the gaps between layers in a rough-notched stack. The scribe distance would be larger than with other methods, but the widest gaps between logs, the widest gaps between layers, and widest gaps in the entire structure could be easily and closely adjustable to be virtually identical. As a result, there would be just one scribe setting for all the grooves, and one scribe setting for all the notches. This embodiment would could employ equipment capable of suspending whole logs, but it would be fast and efficient. Logs would be handled few times, and handling would be safe and non-marking.

Ramification 1 is a device that holds logs that do not extend in one piece from one corner to another corner. Using logs that are shorter than walls would save on material costs by allowing the use of shorter pieces of logs cut where there will be windows or doors. This might be combined with a device mentioned in Embodiment 1 above that both adjusts the gaps between layers of logs and also holds short logs in the rough-notched state.

Ramification 2 concerns flattening sill logs. Eventually, the logs that rest upon the foundation or sub-floor will be flattened on their bottom surface to provide bearing surfaces and stability. The Layer 1 and Layer 2 sill logs can be flattened before they are stacked in the shell. Or Layer 1 sill logs can be flattened and Layer 2 sill logs left round on the bottom until the stacked shell is dismantled. Or both Layer 1 and Layer 2 sill logs could be left round on the bottom until the stacked shell is dismantled. The options that delay cutting some of the sill logs flat have the advantage of allowing for flexibility in the height of the wall and in door headers, which is useful because it allows door headers to be located in convenient portion of the wall log.

Ramification 3 concerns scaffolding log walls. Because an accelerated building is easier and less expensive to scaffold, it is possible to cut some or all of the rough-notches from scaffolding instead of bringing the log to the ground. This would reduce by two the number of times that logs are handled in an accelerated building. This would mean 4 lifts versus 7 lifts for the traditional building.

Ramification 4 concerns a technique variously called underscribing or overscribing. This is a way of varying the scribe distances of the corner notches so that newly-completed log shells have tightly-fitting corner notches and slightly loose long grooves. Over time, as the logs lose moisture and shrink in diameter, some of the weight is transferred to the long grooves. The notch scribe-setting is calculated as above and then reduced by the underscribe amount desired for that log.

While a preferred embodiment of the present invention has been described, it should be understood that various changes, adaptations, and modifications may be made therein without departing from the spirit of the invention and the scope of the appended claims.

What is claimed is:

1. A method of building a structure having a plurality of log walls, the method comprising:

a) providing a plurality of logs wherein each log has a first end region and a second end region;

b) positioning a first layer of logs in a spaced-apart configuration;

c) positioning a second layer of logs above the first layer of logs in a crosswise stack wherein each end region of each second-layer log rests above a first-layer log;

d) positioning a third layer of logs above the second layer of logs in a crosswise stack wherein each end region of each third-layer log rests above a second-layer log, each third-layer log lying above and extending alongside an adjacent first-layer log to define a pair of adjacent first-layer and third-layer logs, whereby a first gap is formed between each such pair of adjacent first-layer and third-layer logs;

e) positioning a fourth layer of logs above the third layer of logs in a crosswise stack wherein each end region of each fourth-layer log rests above a third-layer log, each fourth-layer log lying above and extending alongside an adjacent second-layer log to define a pair of adjacent second-layer and fourth-layer logs, whereby a second gap is formed between each such pair of adjacent second-layer and fourth-layer logs;

f) determining a maximum height of the first gaps in the structure;

g) scribing long groove lines representing long groove cuts on all of the third-layer logs using a single long groove scribe setting, the single long groove scribe setting used for all of the third-layer logs being a first vertical distance that is at least as great as the maximum height determined in step f);

h) determining a maximum height of the second gaps in the structure;

i) scribing long groove lines representing long groove cuts on all of the fourth-layer logs using a single long groove scribe setting, the single long groove scribe setting used for all of the fourth-layer logs being a second vertical distance that is at least as great as the maximum height determined in step h);

j) scribing final notch lines on all of the second-layer logs using a single final notch scribe setting, the single final notch scribe setting used for all of the second-layer logs representing a final notch cut that will lower both end regions of each second-layer log by a first drop distance and into a final position when each second-layer final notch is fitted over the first-layer log on which it rests; and k) scribing final notch lines on all of the third-layer logs using a single final notch scribe setting, the single final notch scribe setting used for all of the third-layer logs representing a final notch cut that will lower both end regions of each third-layer log by a second drop distance that is approximately equal to said first vertical distance less said first drop distance when each third-layer final notch is fitted over the second-layer log on which it rests.

2. The method of claim 1 further comprising scribing final notch lines on all of the fourth-layer logs using a single final notch scribe setting, the single final notch scribe setting used for all of the fourth-layer logs representing a final notch cut that will lower both end regions of each fourth-layer log by a third drop distance that is approximately equal to said second vertical distance less said second drop distance when each fourth-layer final notch is fitted over the third-layer log on which it rests.

3. The method of claim 2 further comprising positioning additional layers of logs above the third and fourth layers of logs, said additional layers of logs being arranged in the manner described in steps c) through e) of claim 1, whereby a third gap is formed between each third-layer log and an adjacent log of a first of said additional layers, and a fourth gap is formed between each fourth-layer log and an adjacent log of a second of said additional layers, and so on for all of the logs of said additional layers.

4. The method of claim 3 further comprising determining a maximum height of the third gaps in the structure, scribing long groove lines on all of the logs of said first of said additional layers using a single long groove scribe setting, the single long groove scribe setting used for all of the logs of said first of said additional layers being a third vertical distance that is at least as great as said maximum height of the third gaps in the structure, determining a maximum height of the fourth gaps in the structure, scribing long groove lines on all of the logs of said second of said additional layers using a single long groove scribe setting, the single long groove scribe setting used for all of the logs of said second of said additional layers being a fourth vertical distance that is at least as great as said maximum height of the fourth gaps in the structure, wherein maximum gap heights are determined and long groove lines are scribed in this manner for all of the logs of said additional layers.

5. The method of claim 4 further comprising scribing final notch lines on all of the logs of said first of said additional layers using a single final notch scribe setting, the single final notch scribe setting used for all of the logs of said first of said additional layers representing a final notch cut that will lower both end regions of each of the logs of said first of said additional layers by a fourth drop distance that is approximately equal to said third vertical distance less said third drop distance when each final notch of each log of said first of said additional layers is fitted over the fourth-layer log on which it rests, scribing final notch lines on all of the logs of said second of said additional layers using a single final notch scribe setting, the single final notch scribe setting used for all of the logs of said second of said additional layers representing a final notch cut that will lower both end regions of each of the logs of said second of said additional layers by a fifth drop distance that is approximately equal to said fourth vertical distance less said fourth drop distance when each final notch of each log of said second of said additional layers is fitted over the log of said first of said additional layers on which it rests, wherein final notch lines are scribed in this manner for all of the logs of said additional layers.

6. The method of claim 1 wherein a common long groove scribe setting is used to scribe long groove lines for all of the third-layer and fourth-layer logs, said common long groove scribe setting being slightly greater than the larger of the maximum height determined in step f) of claim 1 and the maximum height determined in step h) of claim 1.

7. The method of claim 6 further comprising positioning additional layers of logs above the third and fourth layers of logs, said additional layers of logs being arranged in the manner described in steps c) through e) of claim 1, wherein said common long groove scribe setting is used to scribe long groove lines for all of the logs of said additional layers.

8. The method of claim 6 wherein one of two alternating final notch scribe settings is used to scribe final notch lines for all of the second-layer, third-layer, and fourth-layer logs, such that a first of said two alternating final notch scribe settings is used to scribe final notch lines for all of the second-layer logs, and a second of said two alternating final notch scribe settings is used to scribe final notch lines for all of the third-layer logs, and said first of said two alternating final notch scribe settings is used to scribe final notch lines for all of the fourth-layer logs.

9. The method of claim 8 further comprising positioning additional layers of logs above the third and fourth layers of logs, said additional layers of logs being arranged in the manner described in steps c) through e) of claim 1, wherein said second of said two alternating final notch scribe settings is used to scribe final notch lines for all of the logs of a first of said additional layers, and said first of said two alternating final notch scribe settings is used to scribe final notch lines for all of the logs of a second of said additional layers, wherein said two alternating final notch scribe settings are used to scribe final notch lines in this alternating manner for all of the logs of said additional layers.

10. The method of claim 6 wherein a common final notch scribe setting is used to scribe final notch lines for all of the second-layer, third-layer, and fourth-layer logs, said common final notch scribe setting being approximately equal to one half of said common long groove scribe setting.

11. The method of claim 10 further comprising positioning additional layers of logs above the third and fourth layers of logs, said additional layers of logs being arranged in the manner described in steps c) through e) of claim 1, wherein said common final notch scribe setting is used to scribe final notch lines for all of the logs of said additional layers.

12. A method of building a structure having a plurality of log walls, the method comprising:

a) providing a plurality of logs wherein each log has a first end region and a second end region;

b) positioning a first layer of logs in a spaced-apart configuration;

c) positioning a second layer of logs above the first layer of logs in a crosswise stack wherein each end region of each second-layer log rests above a first-layer log;

d) positioning a third layer of logs above the second layer of logs in a crosswise stack wherein each end region of each third-layer log rests above a second-layer log, each third-layer log lying above and extending alongside an adjacent first-layer log to define a pair of adjacent first-layer and third-layer logs, whereby a first gap is formed between each such pair of adjacent first-layer and third-layer logs;

e) determining a maximum height of the first gaps in the structure;

f) scribing long groove lines representing long groove cuts on all of the third-layer logs using a single long groove scribe setting, G1, said single long groove scribe setting, G1, used for all of the third-layer logs being at least as great as the maximum height determined in step e);

g) scribing final notch lines on all of the second-layer logs using a single final notch scribe setting, N1, said single final notch scribe setting, N1, used for all of the second-layer logs representing a final notch cut that will lower both end regions of each second-layer log into a final position when each second-layer final notch is fitted over the first-layer log on which it rests; and h) scribing final notch lines representing final notch cuts on all of the third-layer logs using a single final notch scribe setting, N2, where N2=G1−N1.

13. The method of claim 12 further comprising cutting the long groove and final notches into each log according to the lines scribed in steps f) through h) of claim 12.

* * * * *